US008884833B2

(12) United States Patent
Ayatollahi et al.

(10) Patent No.: US 8,884,833 B2
(45) **Date of Patent: *Nov. 11, 2014**

(54) BROADBAND MONOPOLE ANTENNA WITH DUAL RADIATING STRUCTURES

(71) Applicant: BlackBerry Limited, Waterloo (CA)

(72) Inventors: Mina Ayatollahi, Waterloo (CA); Qinjiang Rao, Waterloo (CA)

(73) Assignee: BlackBerry Limited, Waterloo (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/966,428

(22) Filed: Aug. 14, 2013

(65) Prior Publication Data

US 2013/0328737 A1 Dec. 12, 2013

Related U.S. Application Data

(63) Continuation of application No. 12/825,120, filed on Jun. 28, 2010, now Pat. No. 8,531,344.

(51) Int. Cl.

| | |
|---|---|
| ***H01Q 9/16*** | (2006.01) |
| ***H01Q 5/00*** | (2006.01) |
| ***H01Q 9/44*** | (2006.01) |
| ***H01Q 9/04*** | (2006.01) |
| ***H01Q 9/40*** | (2006.01) |
| ***H01Q 9/28*** | (2006.01) |

(52) U.S. Cl.

CPC ..... *H01Q 9/0407* (2013.01); *H01Q 5/0017* (2013.01); *H01Q 9/44* (2013.01); *H01Q 9/40* (2013.01); *H01Q 9/28* (2013.01)

USPC ..... 343/793

(58) Field of Classification Search

USPC ..... 343/793, 700 MS, 769, 846

See application file for complete search history.

(56) References Cited

U.S. PATENT DOCUMENTS

| | | | |
|---|---|---|---|
| 3,403,349 | A | 9/1968 | Wieder |
| 4,356,492 | A | 10/1982 | Kaloi |

(Continued)

FOREIGN PATENT DOCUMENTS

| | | |
|---|---|---|
| CN | 1479409 | 3/2004 |
| CN | 1898837 | 1/2007 |
| WO | 2006084951 A1 | 8/2006 |

OTHER PUBLICATIONS

Chinese Office Action on Chinese Application No. 201180031953.9, issued Jan. 30, 2014.

(Continued)

*Primary Examiner* — Huedung Mancuso

(74) *Attorney, Agent, or Firm* — Moffat & Co.

(57) ABSTRACT

A broadband monopole antenna with dual-radiating elements is provided. In one embodiment, an antenna comprises a ground plane; a first radiating structure having a symmetric configuration along a central axis, comprising a first feed point electrically connected to the base of said first radiating structure along said central axis and a first slot with a corresponding first open-ended strip along said central axis; and a second radiating structure conjoined with said first radiating structure having a symmetric configuration along said central axis, comprising a second feed point electrically connected to the base of said second radiating structure along said central axis and a second slot with a corresponding second open-ended strip along said central axis; and wherein the antenna resonates and operates at a plurality of resonant frequencies.

18 Claims, 20 Drawing Sheets

(56) References Cited

U.S. PATENT DOCUMENTS

| | | | | |
|---|---|---|---|---|
| 6,091,374 | A | 7/2000 | Barnes | |
| 6,466,176 | B1 * | 10/2002 | Maoz et al. | 343/767 |
| 6,624,793 | B1 | 9/2003 | Su et al. | |
| 7,068,230 | B2 | 6/2006 | Qi et al. | |
| 7,148,848 | B2 | 12/2006 | Colburn et al. | |
| 7,327,315 | B2 * | 2/2008 | Starkie et al. | 343/700 MS |
| 7,365,693 | B2 | 4/2008 | Hoshiai et al. | |
| 7,495,616 | B2 | 2/2009 | Tang et al. | |
| 8,059,054 | B2 * | 11/2011 | Mohammadian et al. | 343/795 |
| 8,531,344 | B2 * | 9/2013 | Ayatollahi et al. | 343/793 |
| 2003/0201943 | A1 * | 10/2003 | Kadambi et al. | 343/702 |
| 2004/0017325 | A1 | 1/2004 | Satoh | |
| 2004/0085244 | A1 * | 5/2004 | Kadambi et al. | 343/700 MS |
| 2005/0110687 | A1 | 5/2005 | Starkie et al. | |
| 2006/0097935 | A1 | 5/2006 | Colburn et al. | |
| 2007/0126637 | A1 | 6/2007 | Habib | |
| 2011/0316755 | A1 * | 12/2011 | Ayatollahi et al. | 343/793 |

OTHER PUBLICATIONS

International Search Report and Written Opinion for PCT Application No. PCT/CA2011/050391, mailed Sep. 6, 2011.

Taiwanese Office Action on Taiwanese Patent Application No. 100121875, date of completion of search Jul. 18, 2014.

Extended European Search Report for Eurpoean Application No. 11800034, Mailed Jun. 27, 2014.

Canadian Office Action for Canadian Application No. 2,803,197, dated May 13, 2014.

* cited by examiner

1300

1400

1500

1600

1700

1800

1900

2000

BROADBAND MONOPOLE ANTENNA WITH DUAL RADIATING STRUCTURES

CROSS-REFERENCE TO RELATED APPLICATIONS

The present application is a continuation of U.S. patent application Ser. No. 12/825,120, filed Jun. 28, 2010, the entire contents of which are incorporated herein by reference.

FIELD

The invention generally relates to antennas and, in particular, to a broadband monopole antenna with dual radiating structures for use in wireless communication systems.

BACKGROUND

Wireless communication systems are widely deployed to provide, for example, a broad range of voice and data-related services. Typical wireless communication systems consist of multiple-access communication networks that allow users of wireless devices to share common network resources. These networks typically require multiple-band antennas for transmitting and receiving radio frequency ("RF") signals from wireless devices. Examples of such networks are the global system for mobile communication ("GSM"), which operates between 890 MHz and 960 MHz; the digital communications system ("DCS"), which operates between 1710 MHz and 1880 MHz; the personal communication system ("PCS"), which operates between 1850 MHz and 1990 MHz; and the universal mobile telecommunications system ("UMTS"), which operates between 1920 MHz and 2170 MHz.

In addition, emerging and future wireless communication systems may require wireless devices and infrastructure equipment such as a base station to operate new modes of communication at different frequency bands to support, for instance, higher data rates, increased functionality and more users. Examples of these emerging systems are the single carrier frequency division multiple access ("SC-FDMA") system, the orthogonal frequency division multiple access ("OFDMA") system, and other like systems. An OFDMA system is supported by various technology standards such as evolved universal terrestrial radio access ("E-UTRA"), Wi-Fi, worldwide interoperability for microwave access ("WiMAX"), wireless broadband ("WiBro"), ultra mobile broadband ("UMB"), long-term evolution ("LTE"), and other similar standards.

Moreover, wireless devices and infrastructure equipment may provide additional functionality that requires using other wireless communication systems that operate at different frequency bands. Examples of these other systems are the wireless local area network ("WLAN") system, the IEEE 802.11b system and the Bluetooth system, which operate between 2400 MHz and 2484 MHz; the WLAN system, the IEEE 802.11a system and the HiperLAN system, which operate between 5150 MHz and 5350 MHz; the global positioning system ("GPS"), which operates at 1575 MHz; and other like systems.

Further, many wireless communication systems in both government and industry require a broadband, low profile antenna. Such systems may require antennas that simultaneously support multiple frequency bands. Further, such systems may require dual polarization to support polarization diversity, polarization frequency re-use, or other similar polarization operation.

BRIEF DESCRIPTION OF THE DRAWINGS

In order for this disclosure to be understood and put into practice by one having ordinary skill in the art, reference is now made to exemplary embodiments as illustrated by reference to the accompanying figures. Like reference numbers refer to identical or functionally similar elements throughout the accompanying figures. The figures along with the detailed description are incorporated and form part of the specification and serve to further illustrate exemplary embodiments and explain various principles and advantages, in accordance with this disclosure, where.

Figure 1:
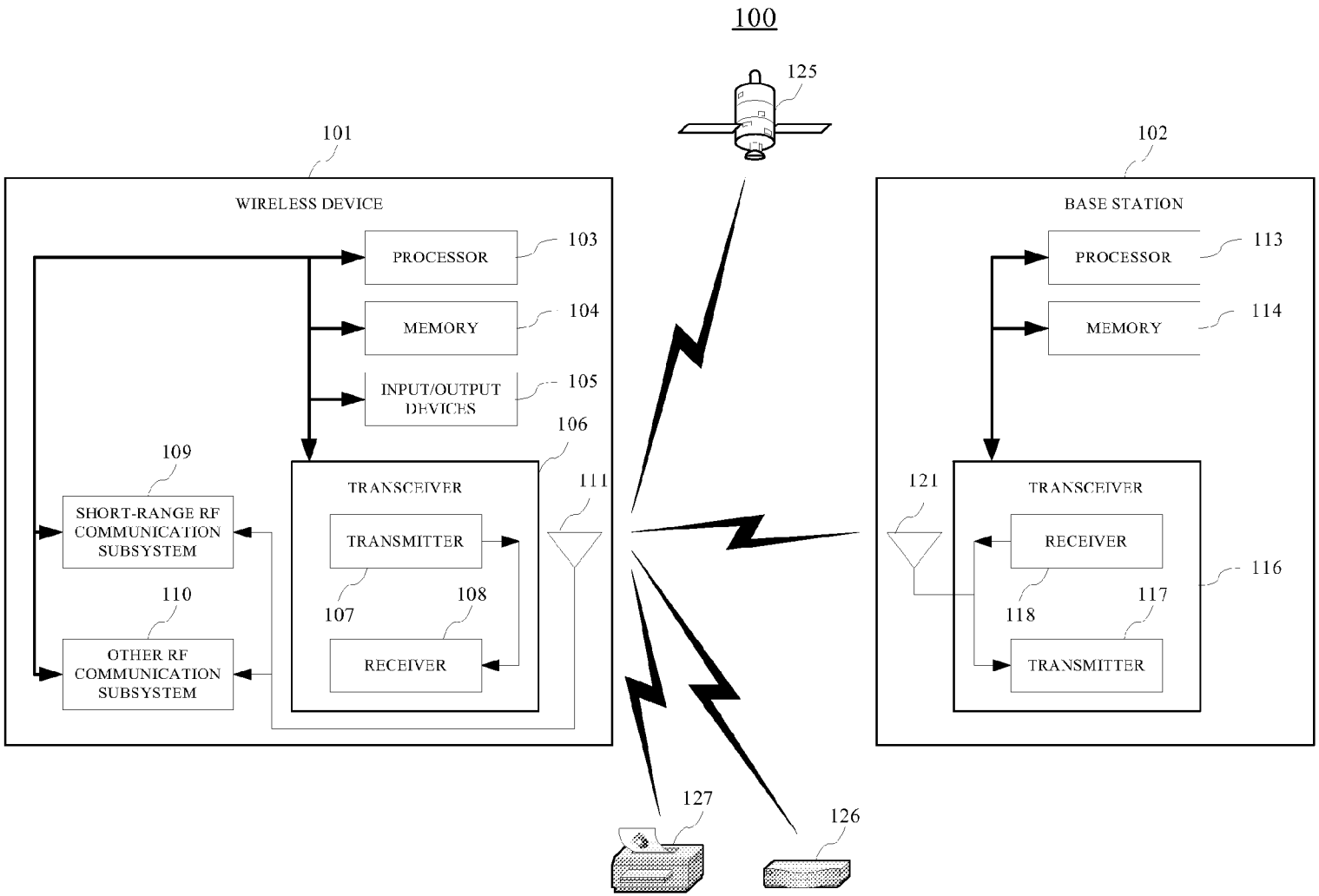
FIG. 1 (PRIOR ART)
FIG. 1 illustrates a wireless communication system in accordance with various aspects set forth herein.

Skilled artisans will appreciate that elements in the accompanying figures are illustrated for clarity, simplicity and to further help improve understanding of the exemplary embodiments, and have not necessarily been drawn to scale.

DETAILED DESCRIPTION

Although the following discloses exemplary methods, devices and systems for use in wireless communication systems, it will be understood by one of ordinary skill in the art that the teachings of this disclosure are in no way limited to the exemplary embodiments shown. On the contrary, it is contemplated that the teachings of this disclosure may be implemented in alternative configurations and environments. For example, although the exemplary methods, devices and systems described herein are described in conjunction with a configuration for aforementioned wireless communication systems, those of ordinary skill in the art will readily recognize that the exemplary methods, devices and systems may be used in other wireless communication systems and may be configured to correspond to such other systems as needed. Accordingly, while the following describes exemplary methods, devices and systems of use thereof, persons of ordinary skill in the art will appreciate that the disclosed exemplary embodiments are not the only way to implement such methods, devices and systems, and the drawings and descriptions should be regarded as illustrative in nature and not restrictive.

Various techniques described herein can be used for various wireless communication systems. The various aspects described herein are presented as methods, devices and systems that can include a number of components, elements, members, modules, peripherals, or the like. Further, these methods, devices and systems can include or not include additional components, elements, members, modules, peripherals, or the like. It is important to note that the terms "network" and "system" can be used interchangeably. Relational terms described herein such as "above" and "below", "left" and "right", "first" and "second", and the like may be used solely to distinguish one entity or action from another entity or action without necessarily requiring or implying any actual such relationship or order between such entities or actions. The term "or" is intended to mean an inclusive "or" rather than an exclusive "or." Further, the terms "a" and "an" are intended to mean one or more unless specified otherwise or clear from the context to be directed to a singular form. The term "electrically connected" as described herein comprises at least by means of a conducting path, or through a capacitor, as distinguished from connected merely through electromagnetic induction.

Wireless communication systems typically consist of a plurality of wireless devices and a plurality of base stations. A base station can also be referred to as a node-B ("NodeB"), a base transceiver station ("BTS"), an access point ("AP"), a satellite, a router, or some other equivalent terminology. A base station typically contains one or more RF transmitters, RF receivers or both electrically connected to one or more antennas to communicate with wireless devices.

A wireless device used in a wireless communication system may also be referred to as a mobile station ("MS"), a terminal, a cellular phone, a cellular handset, a personal digital assistant ("PDA"), a smartphone, a handheld computer, a desktop computer, a laptop computer, a tablet computer, a printer, a set-top box, a television, a wireless appliance, or some other equivalent terminology. A wireless device may contain one or more RF transmitters, RF receivers or both electrically connected to one or more antennas to communicate with a base station. Further, a wireless device may be fixed or mobile and may have the ability to move through a wireless communication network.

FIG. 1 is a block diagram of a wireless communication system 100 in accordance with various aspects described herein. In one embodiment, the system 100 can include one or more wireless devices 101, one or more base stations 102, one or more satellites 125, one or more access points 126, one or more other wireless devices 127, or any combination thereof. The wireless device 101 can include a processor 103 electrically connected to a memory 104, input/output devices 105, a transceiver 106, a short-range RF communication subsystem 109, another RF communication subsystem 110, or any combination thereof, which can be utilized by the wireless device 101 to implement various aspects described herein. The processor 103 can manage and control the overall operation of the wireless device 101. The transceiver 106 of the wireless device 101 can include one or more transmitters 107, one or more receivers 108, or both. Further, associated with the wireless device 101, one or more transmitters 107, one or more receivers 108, one or more short-range RF communication subsystems 109, one or more other RF communication subsystems 110, or any combination thereof can be electrically connected to one or more antennas 111.

In the current embodiment, the wireless device 101 can be capable of two-way voice communication, two-way data communication, or both including with the base station 102. The voice and data communications may be associated with the same or different networks using the same or different base stations 102. The detailed design of the transceiver 106 of the wireless device 101 is dependent on the wireless communication system used. When the wireless device 101 is operating two-way data communication with the base station 102, a text message, for instance, can be received at the antenna 111, can be processed by the receiver 108 of the transceiver 106, and can be provided to the processor 103.

In FIG. 1, the short-range RF communication subsystem 109 may also be integrated in the wireless device 101. For example, the short-range RF communication subsystem 109 may include a Bluetooth module, a WLAN module or both. The short-range RF communication subsystem 109 may use the antenna 111 for transmitting RF signals, receiving RF signals or both. The Bluetooth module can use the antenna 111 to communicate, for instance, with one or more other wireless devices 127 such as a Bluetooth-capable printer. Further, the WLAN module may use the antenna 111 to communicate with one or more access points 126, routers or other similar devices.

In addition, the other RF communication subsystem 110 may be integrated in wireless device 101. For example, the other RF communication subsystem 110 may include a GPS receiver that uses the antenna 111 of the wireless device 101 to receive information from one or more GPS satellites 125. Further, the other RF communication subsystem 110 may use the antenna 111 of the wireless device 101 for transmitting RF signals, receiving RF signals or both.

Similarly, the base station 102 can include a processor 113 coupled to a memory 114 and a transceiver 116, which can be utilized by the base station 102 to implement various aspects described herein. The transceiver 116 of the base station 102 can include one or more transmitters 117, one or more receivers 118, or both. Further, associated with base station 102, one or more transmitters 117, one or more receivers 118, or both can be electrically connected to one or more antennas 121.

In FIG. 1, the base station 102 can communicate with the wireless device 101 on the uplink using one or more antennas 111 and 121, and on the downlink using one or more antennas 111 and 121, associated with the wireless device 101 and the base station 102, respectively. In one embodiment, the base station 102 can originate downlink information using one or more transmitters 117 and one or more antennas 121, where it can be received by one or more receivers 108 at the wireless device 101 using one or more antennas 111. Such information can be related to one or more communication links between the base station 102 and the wireless device 101. Once such information is received by the wireless device 101 on the downlink, the wireless device 101 can process the received information to generate a response relating to the received information. Such response can be transmitted back from the wireless device 101 on the uplink using one or more transmitters 107 and one or more antennas 111, and received at the base station 102 using one or more antennas 121 and one or more receivers 118.

Figure 2:
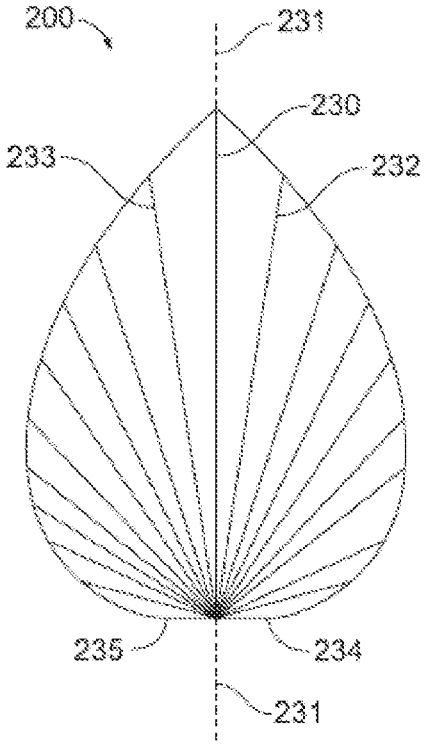
FIG. 2 (PRIOR ART)
FIG. 2 illustrates an example of a radiating structure electrically modeled as a plurality of symmetrically configured, co-sited, quarter wavelength radiating elements.

FIG. 2 illustrates an example of a radiating structure 200 electrically modeled as a plurality of symmetrically configured, co-sited, quarter wavelength radiating elements. In the structure 200 of FIG. 2, except for a central radiating element 230, each radiating element is symmetrically paired with a corresponding radiating element, wherein each paired radiating element is at equal angles to either side of a central axis 231, which is also defined by the central element 230. For example, the radiating element 232 has a corresponding radiating element 233, which are of equal lengths and at equal angles to either side of the central axis 231. Further, the radiating structure 200 has a feed point 240 at its base and along the central axis 231. The feed point 240 allows all of the radiating elements to be co-sited, which can result in reduced phase dispersion. Each pair of symmetrically configured, co-sited, quarter wavelength radiating elements acts as a single vertical dipole element with the same resonant frequency. By combining a substantially infinite number of separate pairs of such radiating elements with varying resonant frequency lengths results in a conceptual model of the radiating structure 200.

In this example, the length of the shortest radiating elements 234 and 235 can determine the maximum frequency of the radiating structure 200, while the longest radiating element, the central element 230, can determine the minimum frequency of the structure 200. One skilled in the art will appreciate that the length of the radiating element of the present disclosure is not limited to a quarter wavelength of the desired resonant frequency, but other lengths may be chosen, such as a half wavelength of the desired resonant frequency.

In addition, the lengths of the radiating elements can define the shape of the radiating structure 200. The shape of the radiating structure 200 can be important in, for instance, the flatness of the frequency response of the structure 200. The shape of the radiating structure 200 can in effect provide a plurality of separate pairs of radiating elements for each frequency within the desired bandwidth of such structure. Further, the shape of the radiating structure 200 can determine the operating frequency bandwidth, input impedance, resonant frequency, polarization characteristics, or any combination thereof. It is important to recognize that while this example uses a generally petal figure for the shape of the radiating structure 200, other shapes can be used such as a circle, rectangle, triangle, oval, cone, square, diamond, some other similar shape, or any combination thereof.

It is important to recognize that the radiating structure 200 is meant to provide a useful understanding of the operation of the various exemplary embodiments of this disclosure. In these embodiments, the radiating structure 200 can be a substantially continuous conductor composed of a substantially infinite number of radiating elements with the radiating elements conceptually representing conducting pathways within such conductor. The radiating structure 200 can be fabricated from, for instance, a thin sheet of substantially uniform resistance material such as copper, aluminum, gold, silver, or other metallic material using a stamping process or any other fabrication technique such as depositing a conductive film on a substrate, or etching previously deposited conductor from a substrate. Further, such fabrication techniques can form the radiating structure 200 into any shape such as a circle, square, triangle, oval, cone, petal, diamond, or some other similar shape. For further information on such radiating structures or in general, see Balanis, *Antenna Theory Analysis and Design,* 3rd ed., Wiley, 2005.

In another embodiment, the radiating structure 200 can be self-supporting and formed from, for instance, a thin sheet of metallic material.

Figure 3:
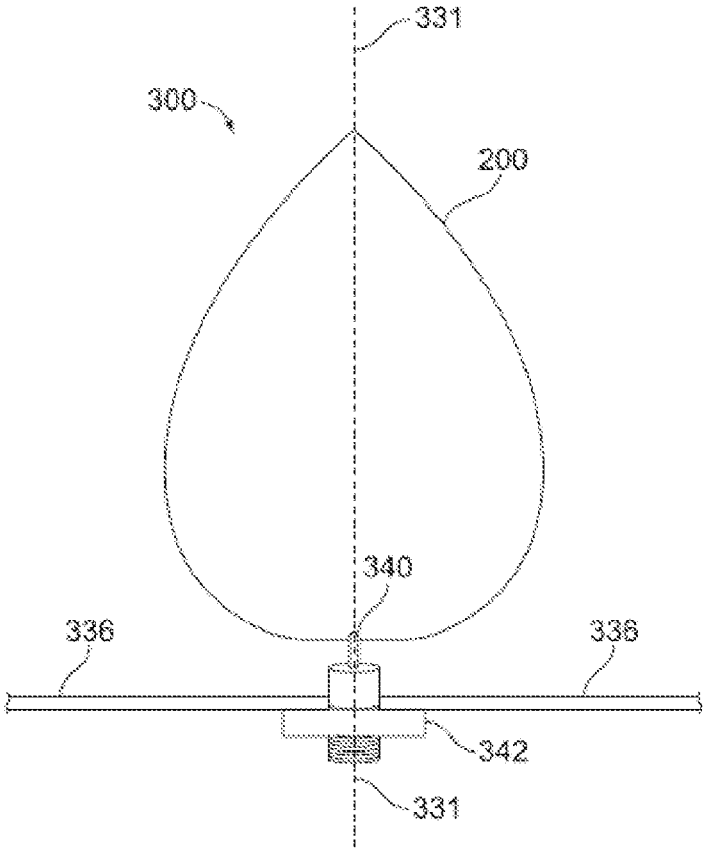
FIG. 3 (PRIOR ART)
FIG. 3 illustrates an example of a broadband monopole antenna utilizing the radiating structure of FIG. 2.

FIG. 3 illustrates an example of a broadband monopole antenna 300 utilizing the radiating structure 200 of FIG. 2. The antenna 300 can include the radiating structure 200, a ground plane 336, a feed point 340, and a feeding line 342. The radiating structure 200 can be symmetric about a central axis 331. Further, the shape of the radiating structure 200 can be a generally petal figure. It is important to recognize that while this exemplary embodiment uses a generally petal figure for the shape of the radiating structure 200, other shapes can be used such as a circle, rectangle, triangle, oval, cone, square, diamond, some other similar shape, or any combination thereof.

In FIG. 3, the antenna 300 can resonate and operate in one or more frequency bands. For example, an RF signal in one of the operating frequency bands is received by the antenna 300 and converted from an electromagnetic signal to an electrical signal for input to a receiver, wherein the receiver is electrically connected to the antenna 300 via the feed point 340. Similarly, an electrical signal in one of the operating frequency bands is input to the antenna 300 for conversion to an electromagnetic signal via the feed points 340, which is electrically connected to a transmitter.

In the current example, the ground plane 336 can be formed from any conducting or partially conducting material such as a portion of a circuit board, copper sheet, or both. The radiating structure 200 can have a feed point 340 at its base and along the central axis 331. Further, the feeding line 342 can pass through or around the ground plane 336 to the base of the radiating structure 200 to the feed point 340.

Figure 4:
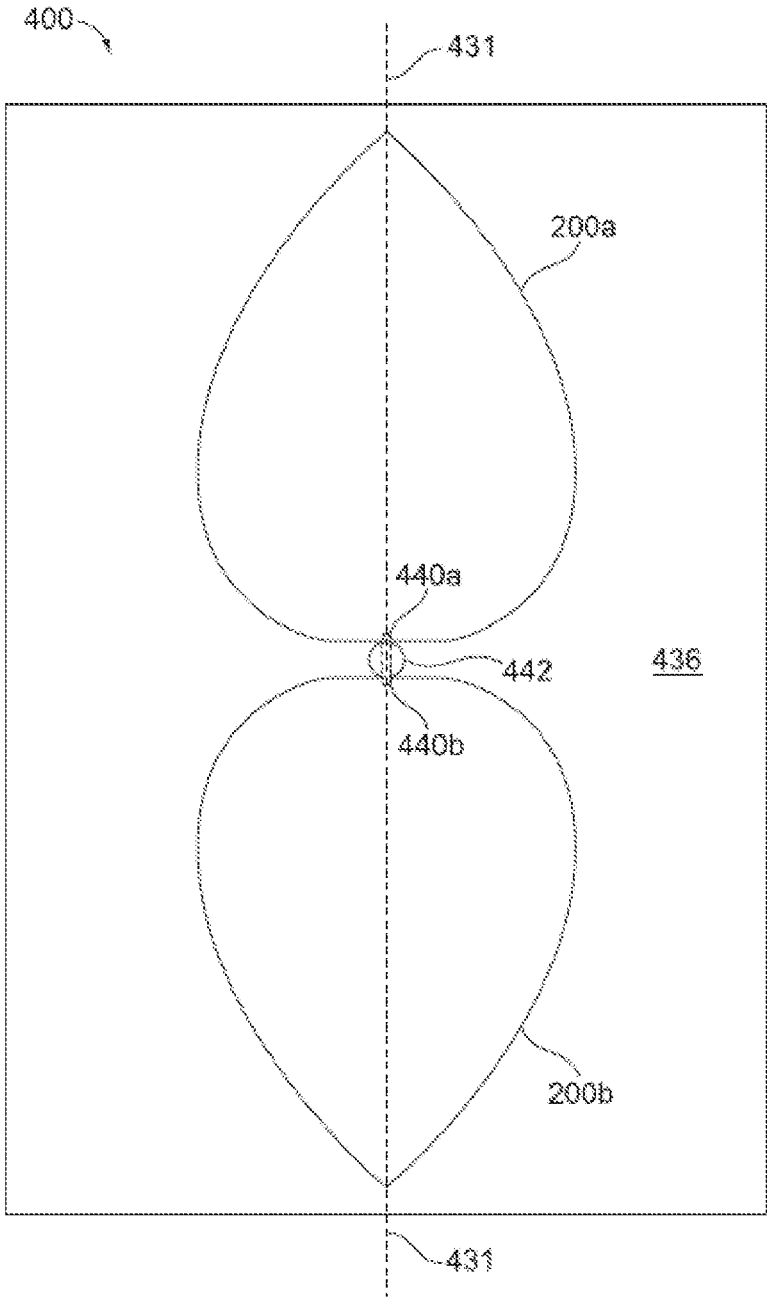
FIG. 4 (PRIOR ART)
FIG. 4 illustrates a top view of an example of a broadband monopole antenna with dual radiating structures utilizing the structure of FIG. 2.

FIG. 4 illustrates an example of a broadband monopole antenna 400 with dual radiating structures utilizing the radiating structure 200 of FIG. 2. In FIG. 4, the antenna 400 can include a pair of radiating structures **200*a* and 200*b*, a ground plane 436, a pair of feed points 440*a* and 440*b*, and a feeding line 442. The antenna 400 can include a symmetric pair of structures 200*a* and 200*b* about a central axis 431. Further, the shape of the first and second radiating structures 200*a* and 200*b* can be generally petal figures. It is important to recognize that while this exemplary embodiment uses generally petal figures for the shape of the first and second radiating structures 200***a* and 200*b*, other shapes can be used such as a circle, rectangle, triangle, oval, cone, square, diamond, some other similar shape, or any combination thereof.

In the current example, the ground plane 436 can be formed from any conducting or partially conducting material such as a portion of a circuit board, copper planar, or both. Each radiating structure 200*a* and 200*b* can have a feed point 440*a* and 440*b*, respectively, at its base along the central axis 431. Further, the feeding line 442 can pass through or around the ground plane 436 to the base of each radiating structure 200*a* and 200*b*, which can allow the feeding line 442 to connect to each feed point 440*a* and 440*b*.

In FIG. 4, the antenna 400 can resonate and operate in one or more frequency bands. For example, an RF signal in one of the operating frequency bands is received by the antenna 400 and converted from an electromagnetic signal to an electrical signal for input to a receiver, wherein the receiver is electrically connected to the antenna 400 via the feed points 440*a* and 440*b*. Similarly, an electrical signal in one of the operating frequency bands is input to the antenna 400 for conversion to an electromagnetic signal via the feed points 440*a* and 440*b*, which are electrically connected to a transmitter.

Figure 5:
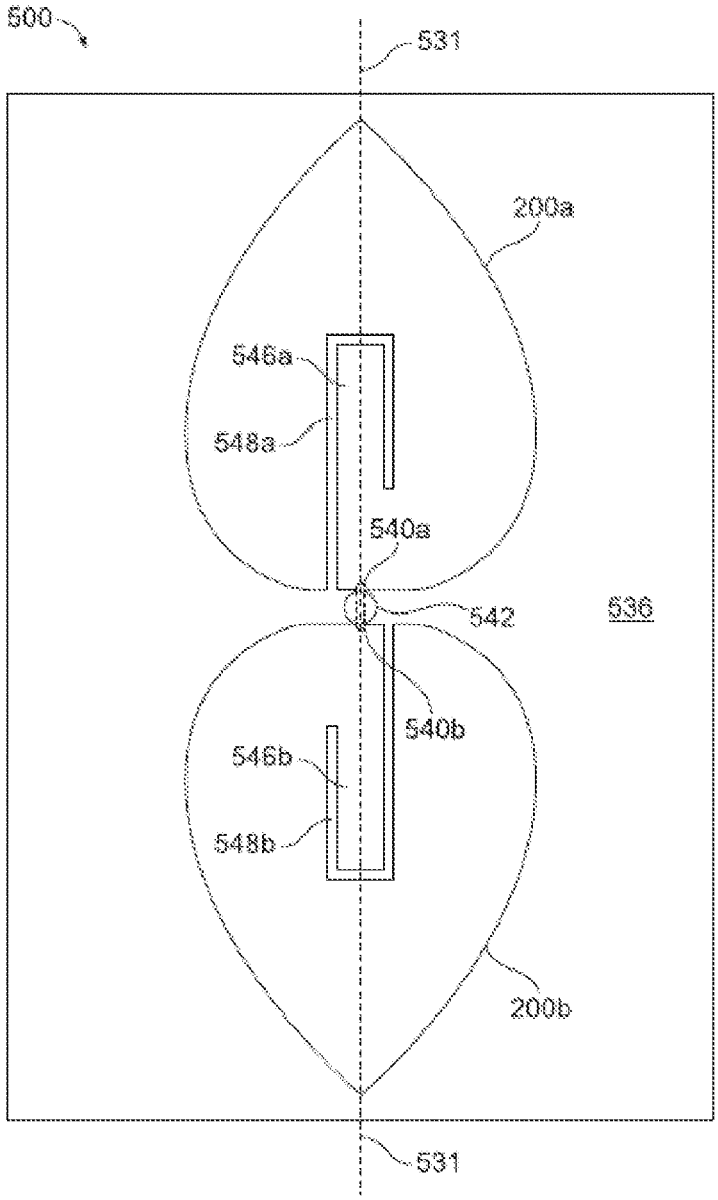
FIG. 5 illustrates a top view of one embodiment of a broadband monopole antenna with dual radiating structures utilizing the radiating structure of FIG. 2 in accordance with various aspects set forth herein.

FIG. 5 is one embodiment of a broadband monopole antenna 500 with dual radiating structures utilizing the radiating structure 200 of FIG. 2 in accordance with various aspects set forth herein. In FIG. 5, the antenna 500 can include a pair of radiating structures 200*a* and 200*b*, a ground plane 536, a first feed point 540*a*, a second feed point 540*b*, a feeding line 542, a first slot 548*a* with a corresponding first open-ended strip 546*a*, and a second slot 548*b* with a corresponding second open-ended strip 546*b*. The antenna 500 can include a symmetric pair of structures 200*a* and 200*b* about a central axis 531, wherein each structure 200*a* and 200*b* can have a feed point 540*a* and 540*b*, respectively, at its base along the central axis 531. Further, the shape of the first and second radiating structures 200*a* and 200*b* can be generally petal figures. It is important to recognize that while this exemplary embodiment uses generally petal figures for the shape of the first and second radiating structures 200*a* and 200*b*, other shapes can be used such as a circle, rectangle, triangle, oval, cone, square, diamond, some other similar shape, or any combination thereof.

In this embodiment, the antenna 500 can resonate and operate in one or more frequency bands. For example, an RF signal in one of the operating frequency bands is received by the antenna 500 and converted from an electromagnetic signal to an electrical signal for input to a receiver, wherein the receiver is electrically connected to the antenna 500 via the feed points 540*a* and 540*b*. Similarly, an electrical signal in one of the operating frequency bands is input to the antenna 500 for conversion to an electromagnetic signal via the feed points 540*a* and 540*b*, which are electrically connected to a transmitter.

In FIG. 5, the ground plane 536 can be formed from any conducting or partially conducting material such as a portion of a circuit board, copper planar, or both. The feeding line 542 can pass through or around the ground plane 536 to be electrically connected to the first and second feed points 540*a* and 540*b*, which can be located at the base of each radiating structure 200*a* and 200*b*, respectively. The feeding line 542 can be, for instance, a microstrip feed line, a probe feed, an aperture-coupled feed, a proximity coupled feed, other feed, or any combination thereof. The feeding line 542 can be electrically connected to the first and second feed points 540*a* and 540*b*, respectively, for transmitting RF signals, receiving RF signals, or both. The feeding line 542 can be, for example, a sub-miniature version A ("SMA") connector, wherein an internal terminal can act as a feeding point to the first and second feed points 540*a* and 540*b*, respectively, and the outside terminal can be electrically connected to the ground plane 536. SMA connectors are coaxial RF connectors developed as a minimal connector interface for a coaxial cable with a screw-type coupling mechanism. An SMA connector typically has a fifty-ohm impedance and offers excellent electrical performance over a broad frequency range.

In the current embodiment, the first slot 548*a* can be formed in a central location of the radiating structure 200*a* along the central axis 531. The function of a slot includes physically partitioning the radiating member into a subset of radiating members, providing reactive loading to modify the resonant frequency or frequencies of a radiating member, modifying the frequency bandwidth of a radiating member, providing further impedance matching for a radiating member, changing the polarization characteristics of a radiating member, or any combination thereof. Further, the first open-ended strip 546*a* corresponding to first slot 548*a* can be formed in a central location of the radiating structure 200*a* along the central axis 531, wherein a side of the open-ended strip 546*a* can extend to the edge of the radiating structure 200*a* to form a notch. The function of a strip includes providing reactive loading to modify the resonant frequency or frequencies of a radiating member, modifying the frequency bandwidth of a radiating member, providing further impedance matching for a radiating member, changing the polarization characteristics of a radiating member, or any combination thereof.

Similarly, the second slot 548*b* can be formed in a central location of radiating structure 200*b* along the central axis 532. Further, the second open-ended strip 546*b* corresponding to second slot 548*b* can be formed in a central location of radiating structure 200*a* along the central axis 531, wherein a side of the open-ended strip 546*b* can extend to the edge of the radiating structure 200*b* to form a notch. The location, length, width, shape, or any combination thereof of the first and second slots 548*a* and 548*b*, respectively, can be adjusted to modify the operating frequency bandwidth, input impedance, resonant frequency, polarization characteristics, or any combination thereof of the antenna 500. Further, the location, length, width, shape, or any combination thereof of the first and second open-ended strips 548*a* and 548*b*, respectively, can be adjusted to modify the operating frequency bandwidth, input impedance, resonant frequency, polarization characteristics, or any combination thereof of the antenna 500.

In addition, the angle of the first and second open-ended strips 546*a* and 546*b* relative to radiating structure 200*a* and 200*b*, respectively, can be adjusted to modify the operating frequency bandwidth, input impedance, resonant frequency, polarization characteristics, or any combination thereof of the antenna 500. Tuning of the input impedance of an antenna typically refers to matching the impedance seen by an antenna at its input terminals such that the input impedance is purely resistive with no reactive component.

In another embodiment, the feeding line 542 can be configured as a coaxial cable with an internal terminal electrically connected to the first and second feed points 540*a* and 540*b*, respectively, and the outside terminal electrically connected to the ground plane 536.

In another embodiment, the feeding line 542 can be differentially configured as a coaxial cable with an internal terminal electrically connected to the first feed point 540*a* and the outside terminal electrically connected to the second feed point 540*b*.

In another embodiment, a dielectric material can be set between any combination of the radiating structure 200*a*, the radiating structure 200*b*, and the ground plane 536. The dielectric material can be, for instance, the air, a substrate, a polystyrene, or any combination thereof.

In another embodiment, the first open-ended strip 546*a* corresponding to first slot 548*a* can be formed in a central location of the radiating structure 200*a* along the central axis 531, wherein no sides of the open-ended strip 546*a* can extend to the edge of the radiating structure 200*a* to form a notch. Similarly, the second open-ended strip 546*b* corresponding to second slot 548*b* can be formed in a central location of radiating structure 200*a* along the central axis 531, wherein no sides of the open-ended strip 546*b* can extend to the edge of the radiating structure 200*b* to form a notch.

In another embodiment, RF signals in one or more operating frequency bands of antenna 500 can be received and transmitted by the radiating structures 200*a* and 200*b* of antenna 500 of wireless device 101. An RF signal in one of the operating frequency bands can be received by the antenna 500 and converted from an electromagnetic signal to an electrical signal for input to the receiver 108 of the transceiver 106, the short-range RF communication subsystem 109, the other RF communication device 110, or any combination thereof, which is electrically connected to the first and second feed points 540*a* and 540*b*. Similarly, an electrical signal in one of the operating frequency bands can be input to the antenna 500 for conversion to an electromagnetic signal via the first and second feed points 540*a* and 540*b*, respectively, which are electrically connected to the transmitter 107 of the transceiver 106, the short-range RF communication subsystem 109, the other RF communication subsystem 110, or any combination thereof.

In another embodiment, RF signals in one or more operating frequency bands of antenna 500 can be received and transmitted by the radiating structures 200*a* and 200*b* of antenna 500 of base station 102. An RF signal in one of the operating frequency bands can be received by the antenna 500 and converted from an electromagnetic signal to an electrical signal for input to the receiver 118 of the transceiver 116, which is electrically connected to the first and second feed points 540*a* and 540*b*. Similarly, an electrical signal in one of the operating frequency bands can be input to the antenna 500 for conversion to an electromagnetic signal via the first and second feed points 540*a* and 540*b*, respectively, which are electrically connected to the transmitter 117 of the transceiver 116.

Figure 6:
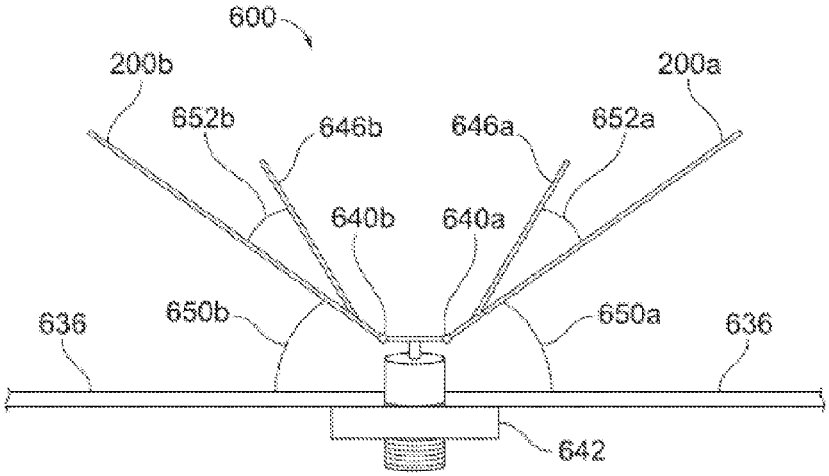
FIG. 6 illustrates a side view of another embodiment of a broadband monopole antenna with dual radiating structures utilizing the radiating structure of FIG. 2 in accordance with various aspects set forth herein.

FIG. 6 illustrates a side view of another embodiment of a broadband monopole antenna 600 with dual radiating structures utilizing the radiating structure of FIG. 2 in accordance with various aspects set forth herein. In FIG. 6, the antenna 600 can include a pair of radiating structures 200*a* and 200*b*, a ground plane 636, a first feed point 640*a*, a second feed point 640*b*, a feeding line 642, a first slot with a corresponding first open-ended strip 646*a*, and a second slot with a corresponding second open-ended strip 646*b*. The antenna 600 can include a symmetric pair of structures 200*a* and 200*b* about a central axis, wherein each structure 200*a* and 200*b* can have a feed point 640*a* and 640*b*, respectively, at its base along the central axis. Further, the shape of the first and second radiating structures 200*a* and 200*b* can be generally a circle, petal, rectangle, triangle, oval, cone, square, diamond, some other similar shape, or any combination thereof.

In this embodiment, the ground plane 636 can be formed from any conducting or partially conducting material such as a portion of a circuit board, copper planar, or both. The feeding line 642 can pass through or around the ground plane 636 to be electrically connected to the first and second feed points 640*a* and 640*b*, which can be located at the base of each radiating structure 200*a* and 200*b*, respectively. The feeding line 642 can be, for instance, a microstrip feed line, a probe feed, an aperture-coupled feed, a proximity coupled feed, other feed, or any combination thereof. The feeding line 642 can be, electrically connected to the first and second feed points 640*a* and 640*b*, respectively, for transmitting RF signals, receiving RF signals, or both.

In FIG. 6, a first angle 650*a* measured between the structure 200*a* and ground plane 636 can be adjusted to modify the operating frequency bandwidth, input impedance, resonant frequency, polarization characteristics, or any combination thereof of the antenna 600. Similarly, a second angle 650*b* measured between the structure 200*b* and the ground plane 636 can be adjusted to modify the operating frequency bandwidth, input impedance, resonant frequency, polarization characteristics, or any combination thereof of the antenna 600. It is important to recognize that polarization diversity can be supported as long as the first radiating structure 200*a* and the second radiating structure 200*b* are not parallel or planar. Further, frequency diversity can be supported if the first and second angles 650*a* and 650*b*, respectively, are different, since such angles can change the resonant frequency of each structure 200*a* and 200*b*.

In the current embodiment, a third angle 652*a* measured between the strip 646*a* and the structure 200*a* can be adjusted to modify the operating frequency bandwidth, input impedance, resonant frequency, polarization characteristics, or any combination thereof of the antenna 600. Similarly, a fourth angle 652*b* measured between the strip 646*b* and the structure 200*b* can be adjusted to modify the operating frequency bandwidth, input impedance, resonant frequency, polarization characteristics, or any combination thereof of the antenna 600. The angles 650*a*, 650*b*, 652*a* and 652*b* can be in the range from zero degrees to three hundred and sixty degrees. It is important to recognize that modifying the operating frequency bandwidth, input impedance, resonant frequency, polarization characteristics, or any combination thereof may require adjusting the first angle 650*a*, second angle 650*b*, third angle 652*a*, fourth angle 652*b*, or any combination thereof to achieve the desired results.

In FIG. 6, the first and second angles 650*a* and 650*b* are about thirty degrees measured between the structures 200*a* and 200*b* and the ground plane 636, respectively. Further, the third and fourth angles 652*a* and 652*b* are about thirty degrees measured between the strips 646*a* and 646*b* and the structures 200*a* and 200*b*, respectively.

In another embodiment, the first and second angles 650*a* and 650*b* are about forty-five degrees measured between the structures 200*a* and 200*b* and the ground plane 636, respectively. Further, the third and fourth angles 652*a* and 652*b* are about zero degrees measured between the strips 646*a* and 646*b* and the structures 200*a* and 200*b*, respectively.

In another embodiment, the first and second angles 650*a* and 650*b* are about sixty degrees measured between the structures 200*a* and 200*b* and the ground plane 636, respectively. Further, the third and fourth angles 652*a* and 652*b* are about zero degrees measured between the strips 646*a* and 646*b* and the structures 200*a* and 200*b*, respectively.

In another embodiment, the feeding line 642 can be configured as a coaxial cable with an internal terminal electrically connected to the first and second feed points 640*a* and 640*b*, respectively, and the outside terminal electrically connected to the ground plane 636.

In another embodiment, the feeding line 642 can be differentially configured as a coaxial cable with an internal terminal electrically connected to the first feed point 640*a* and the outside terminal electrically connected to the second feed point 640*b*.

In another embodiment, a dielectric material can be set between any combination of the radiating structure 200*a*, the radiating structure 200*b*, and the ground plane 636.

Figure 7:
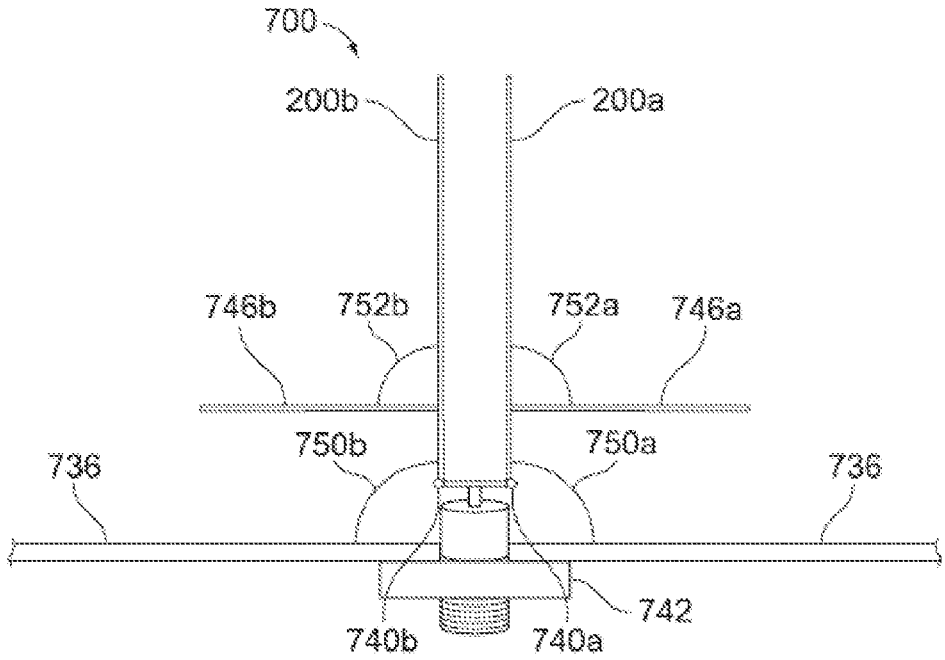
FIG. 7 illustrates a side view of another embodiment of a broadband monopole antenna with dual radiating structures utilizing the radiating structure of FIG. 2 in accordance with various aspects set forth herein.

FIG. 7 illustrates a side view of another embodiment of a broadband monopole antenna 700 with dual radiating structures utilizing the radiating structure of FIG. 2 in accordance with various aspects set forth herein. In FIG. 7, the antenna 700 can include a pair of radiating structures 200*a* and 200*b*, a ground plane 736, a first feed point 740*a*, a second feed point 740*b*, a feeding line 742, a first slot with a corresponding first open-ended strip 746*a*, and a second slot with a corresponding second open-ended strip 746*b*. The antenna 700 can include a symmetric pair of structures 200*a* and 200*b* about a central axis, wherein each structure 200*a* and 200*b* can have a feed point 740*a* and 740*b*, respectively, at its base along the central axis. Further, the shape of the first and second radiating structures 200*a* and 200*b* can be generally a circle, petal, rectangle, triangle, oval, cone, square, diamond, some other similar shape, or any combination thereof.

In the current embodiment, the ground plane 736 can be formed from any conducting or partially conducting material such as a portion of a circuit board, copper planar, or both. The feeding line 742 can pass through or around the ground plane 736 to be electrically connected to the first and second feed points 740*a* and 740*b*, which can be located at the base of each radiating structure 200*a* and 200*b*, respectively. The feeding line 742 can be, for instance, a micro-strip feed line, a probe feed, an aperture-coupled feed, a proximity coupled feed, other feed, or any combination thereof. The feeding line 742 can be, electrically connected to the first and second feed points 740*a* and 740*b*, respectively, for transmitting RF signals, receiving RF signals, or both.

In this embodiment, a first angle 750*a* measured between the structure 200*a* and ground plane 736 can be adjusted to modify the operating frequency bandwidth, input impedance, resonant frequency, polarization characteristics, or any combination thereof of the antenna 700. Similarly, a second angle 750*b* measured between the structure 200*b* and the ground plane 736 can be adjusted to modify the operating frequency bandwidth, input impedance, resonant frequency, polarization characteristics, or any combination thereof of the antenna 700. Further, a third angle 752*a* measured between the strip 746*a* and the structure 200*a* can be adjusted to modify the operating frequency bandwidth, input impedance, resonant frequency, polarization characteristics, or any combination thereof of the antenna 700. Similarly, a fourth angle 752*b* measured between the strip 746*b* and the structure 200*b* can be adjusted to modify the operating frequency bandwidth, input impedance, resonant frequency, polarization characteristics, or any combination thereof of the antenna 700. The angles 750*a*, 750*b*, 752*a* and 752*b* can be in the range from zero degrees to three hundred and sixty degrees. It is important to recognize that modifying the operating frequency bandwidth, input impedance, resonant frequency, polarization characteristics, or any combination thereof may require adjusting the first angle 750*a*, second angle 750*b*, third angle 752*a*, fourth angle 752*b*, or any combination thereof to achieve the desired results.

In FIG. 7, the first and second angles 750*a* and 750*b* are about ninety degrees measured between the structures 200*a* and 200*b* and the ground plane 736, respectively. Further, the third and fourth angles 752*a* and 752*b* are about ninety degrees measured between the strips 746*a* and 746*b* and the structures 200*a* and 200*b*, respectively.

In another embodiment, the first and second angles 750*a* and 750*b* are about ninety degrees measured between the structures 200*a* and 200*b* and the ground plane 736, respectively. Further, the third and fourth angles 752*a* and 752*b* are about zero degrees measured between the strips 746*a* and 746*b* and the structures 200*a* and 200*b*, respectively.

In another embodiment, the feeding line 742 can be configured as a coaxial cable with an internal terminal electrically connected to the first and second feed points 740*a* and 740*b*, respectively, and the outside terminal electrically connected to the ground plane 736.

In another embodiment, the feeding line 742 can be differentially configured as a coaxial cable with an internal terminal electrically connected to the first feed point 740*a* and the outside terminal electrically connected to the second feed point 740*b*.

In another embodiment, dielectric material can reside between all or a portion of the radiating structure 200*a* and the radiating structure 200*b*.

In another embodiment, a dielectric material can be set between any combination of the radiating structure 200*a*, the radiating structure 200*b*, and the ground plane 736.

In another embodiment, the distance between the radiating structure 200*a* and the radiating structure 200*b* can be adjusted to modify the operating frequency bandwidth, input impedance, resonant frequency, polarization characteristics, or any combination thereof of the antenna 700.

In another embodiment, the distance between the radiating structure 200*a* and the radiating structure 200*b* can be less than a wavelength of the smallest resonant frequency of the antenna 700.

Figure 8:
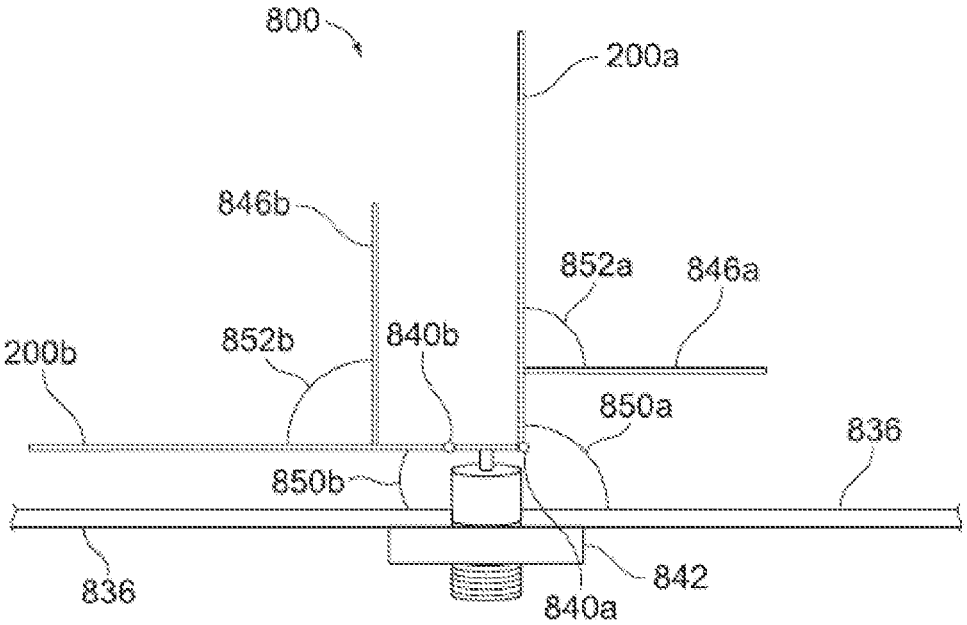
FIG. 8 illustrates a side view of another embodiment of a broadband monopole antenna with dual radiating structures utilizing the radiating structure of FIG. 2 in accordance with various aspects set forth herein.

FIG. 8 illustrates a side view of another embodiment of a broadband monopole antenna 800 with dual radiating structures utilizing the radiating structure of FIG. 2 in accordance with various aspects set forth herein. In FIG. 8, the antenna 800 can include a pair of radiating structures 200*a* and 200*b*, a ground plane 836, a first feed point 840*a*, a second feed point 840*b*, a feeding line 842, a first slot with a corresponding first open-ended strip 846*a*, and a second slot with a corresponding second open-ended strip 846*b*. The antenna 800 can include a symmetric pair of structures 200*a* and 200*b* about a central axis, wherein each structure 200*a* and 200*b* can have a feed point 840*a* and 840*b*, respectively, at its base along the central axis. Further, the shape of the first and second radiating structures 200*a* and 200*b* can be generally a circle, petal, rectangle, triangle, oval, cone, square, diamond, some other similar shape, or any combination thereof.

In this embodiment, the ground plane 836 can be formed from any conducting or partially conducting material such as a portion of a circuit board, copper planar, or both. The feeding line 842 can pass through or around the ground plane 836 to be electrically connected to the first and second feed points 840*a* and 840*b*, which can be located at the base of each radiating structure 200*a* and 200*b*, respectively. The feeding line 842 can be, for instance, a micro-strip feed line, a probe feed, an aperture-coupled feed, a proximity coupled feed, other feed, or any combination thereof. The feeding line 842 can be electrically connected to the first and second feed points 840*a* and 840*b*, respectively, for transmitting RF signals, receiving RF signals, or both.

In the current embodiment, a first angle 850*a* measured between the structure 200*a* and ground plane 836 can be adjusted to modify the operating frequency bandwidth, input impedance, resonant frequency, polarization characteristics, or any combination thereof of the antenna 800. Similarly, a second angle 850*b* measured between the structure 200*b* and the ground plane 836 can be adjusted to modify the operating frequency bandwidth, input impedance, resonant frequency, polarization characteristics, or any combination thereof of the antenna 800. Further, a third angle 852*a* measured between the strip 846*a* and the structure 200*a* can be adjusted to modify the operating frequency bandwidth, input impedance, resonant frequency, polarization characteristics, or any combination thereof of the antenna 800. Similarly, a fourth angle 852*b* measured between the strip 846*b* and the structure 200*b* can be adjusted to modify the operating frequency bandwidth, input impedance, resonant frequency, polarization characteristics, or any combination thereof of the antenna 800. The angles 850*a*, 850*b*, 852*a* and 852*b* can be in the range from zero degrees up to three hundred and sixty degrees. It is important to recognize that modifying the operating frequency bandwidth, input impedance, resonant frequency, polarization characteristics, or any combination thereof may require adjusting the first angle 850*a*, second angle 850*b*, third angle 852*a*, fourth angle 852*b*, or any combination thereof to achieve the desired results.

In FIG. 8, the first angle 850*a* is about ninety degrees measured between the structure 200*a* and the ground plane 836. The second angle 850*b* is about zero degrees measured between the structure 200*b* and the ground plane 836. Further, the third angle 852*a* is about ninety degrees measured between the strips 846*a* and the structure 200*a*. The fourth angle 852*b* is about ninety degrees measured between the strip 846*b* and the structure 200*b*, respectively.

In another embodiment, the first angle 850*a* is about ninety degrees measured between the structure 200*a* and the ground plane 836. The second angle 850*b* is about zero degrees measured between the structure 200*b* and the ground plane 836. Further, the third and fourth angles 852*a* and 852*b* are about zero degrees measured between the strips 846*a* and 846*b* the structure 200*a* and 200*b*, respectively.

In another embodiment, the structures 200*a* and 200*b* form about a ninety degree angle.

In another embodiment, the structures 200*a* and 200*b* form about a zero degree angle.

In another embodiment, the feeding line 842 can be configured as a coaxial cable with an internal terminal electrically connected to the first and second feed points 840*a* and 840*b*, respectively, and the outside terminal electrically connected to the ground plane 836.

In another embodiment, the feeding line 842 can be differentially configured as a coaxial cable with an internal terminal electrically connected to the first feed point 840*a* and the outside terminal electrically connected to the second feed point 840*b*.

In another embodiment, a dielectric material can be set between any combination of the radiating structure 200*a*, the radiating structure 200*b*, and the ground plane 836.

Figure 9:
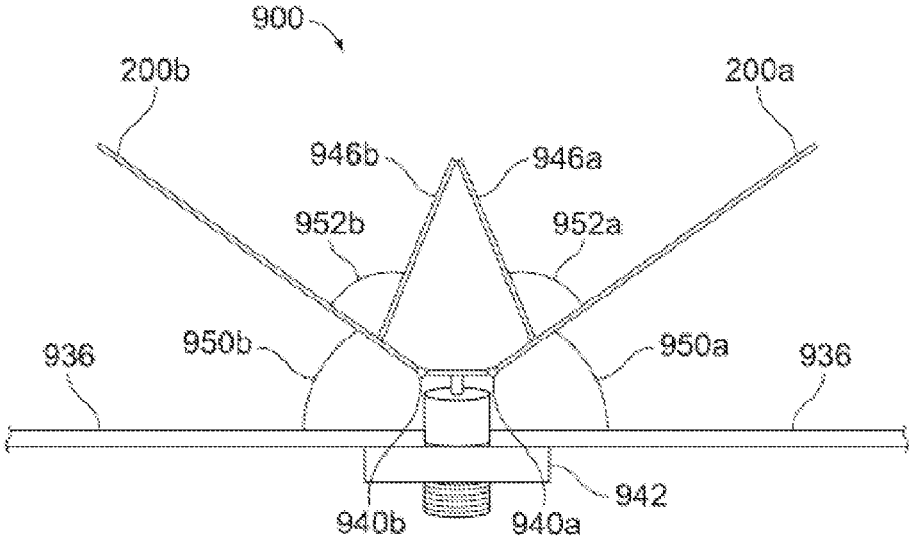
FIG. 9 illustrates a side view of another embodiment of a broadband monopole antenna with dual radiating structures utilizing the radiating structure of FIG. 2 in accordance with various aspects set forth herein.

FIG. 9 illustrates a side view of another embodiment of a broadband monopole antenna 900 with dual radiating structures utilizing the radiating structure of FIG. 2 in accordance with various aspects set forth herein. In FIG. 9, the antenna 900 can include a pair of radiating structures 200*a* and 200*b*, a ground plane 936, a first feed point 940*a*, a second feed point 940*b*, a feeding line 942, a first slot with a corresponding first open-ended strip 946*a*, and a second slot with a corresponding second open-ended strip 946*b*. The antenna 900 can include a symmetric pair of structures 200*a* and 200*b* about a central axis, wherein each structure 200*a* and 200*b* can have a feed point 940*a* and 940*b*, respectively, at its base along the central axis. Further, the shape of the first and second radiating structures 200*a* and 200*b* can be generally a circle, petal, rectangle, triangle, oval, cone, square, diamond, some other similar shape, or any combination thereof.

In this embodiment, the ground plane 936 can be formed from any conducting or partially conducting material such as a portion of a circuit board, copper planar, or both. The feeding line 942 can pass through or around the ground plane 936 to be electrically connected to the first and second feed points 940*a* and 940*b*, which can be located at the base of each radiating structure 200*a* and 200*b*, respectively. The feeding line 942 can be, for instance, a micro-strip feed line, a probe feed, an aperture-coupled feed, a proximity coupled feed, other feed, or any combination thereof. The feeding line 942 can be, for instance, placed on the surface of ground plane 936 and electrically connected to the first and second feed points 940*a* and 940*b*, respectively, for transmitting RF signals, receiving RF signals, or both.

In the current embodiment, a first angle 950*a* measured between the structure 200*a* and ground plane 936 can be adjusted to modify the operating frequency bandwidth, input impedance, resonant frequency, polarization characteristics, or any combination thereof of the antenna 900. Similarly, a second angle 950*b* measured between the structure 200*b* and the ground plane 936 can be adjusted to modify the operating frequency bandwidth, input impedance, resonant frequency, polarization characteristics, or any combination thereof of the antenna 900. Further, a third angle 952*a* measured between the strip 946*a* and the structure 200*a* can be adjusted to modify the operating frequency bandwidth, input impedance, resonant frequency, polarization characteristics, or any combination thereof of the antenna 800. Similarly, a fourth angle 952*b* measured between the strip 946*b* and the structure 200*b* can be adjusted to modify the operating frequency bandwidth, input impedance, resonant frequency, polarization characteristics, or any combination thereof of the antenna 900. The angles 950*a*, 950*b*, 952*a* and 952*b* can be in the range from zero degrees to three hundred and sixty degrees. It is important to recognize that modifying the operating frequency bandwidth, input impedance, resonant frequency, polarization characteristics, or any combination thereof may require adjusting the first angle 950*a*, second angle 950*b*, third angle 952*a*, fourth angle 952*b*, or any combination thereof to achieve the desired results.

In FIG. 9, the ends of the strips 946*a* and 946*b* can be electrically connected to allow for further modifying the operating frequency bandwidth, input impedance, resonant frequency, polarization characteristics, or any combination thereof.

In another embodiment, the feeding line 942 can be configured as a coaxial cable with an internal terminal electrically connected to the first and second feed points 940*a* and 940*b*, respectively, and the outside terminal electrically connected to the ground plane 936.

In another embodiment, the feeding line 942 can be differentially configured as a coaxial cable with an internal terminal electrically connected to the first feed point 940*a* and the outside terminal electrically connected to the second feed point 940*b*.

In another embodiment, a dielectric material can be set between any combination of the radiating structure 200*a*, the radiating structure 200*b*, and the ground plane 936.

Figure 10:
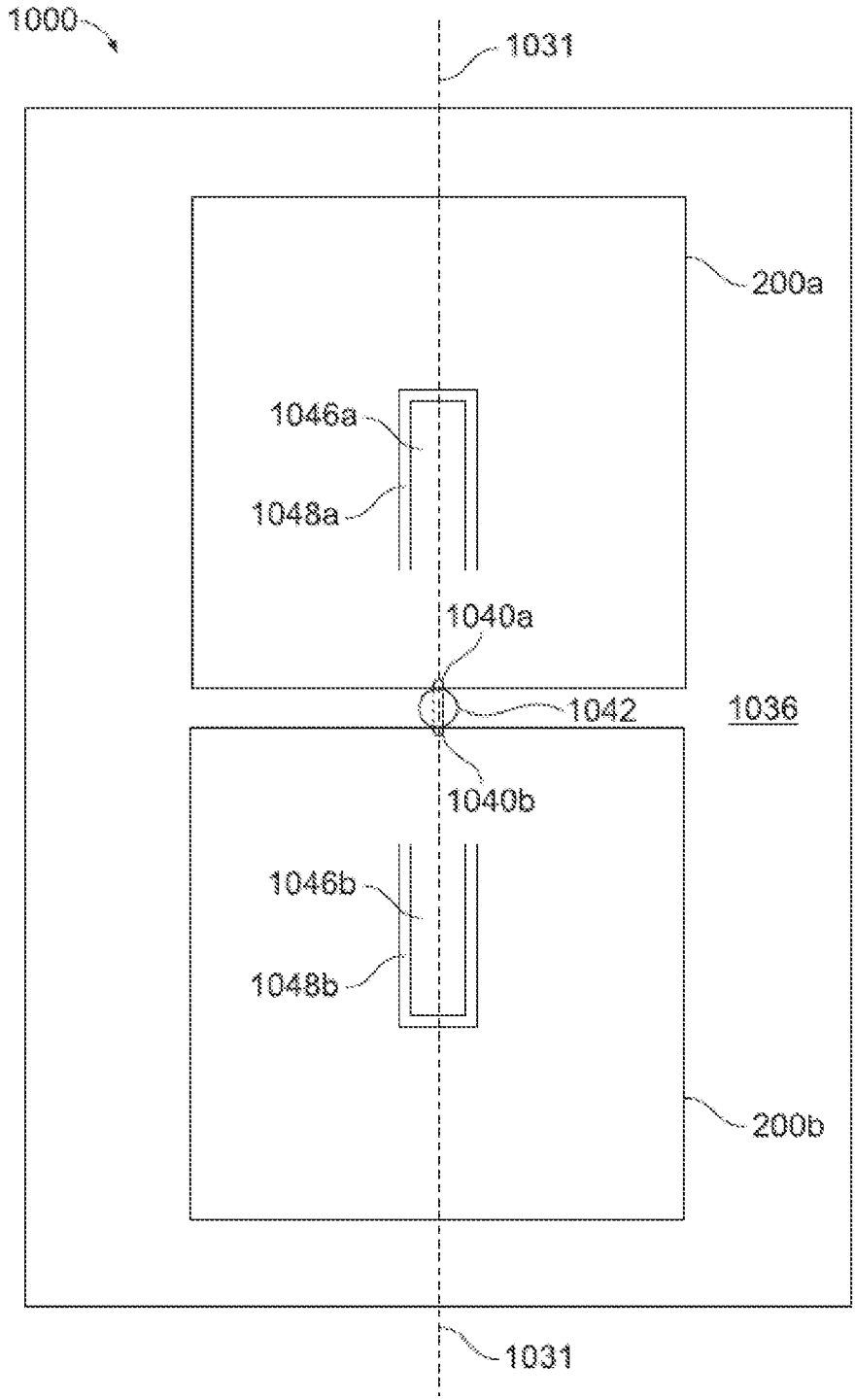
FIG. 10 illustrates a top view of another embodiment of a broadband monopole antenna with dual radiating structures utilizing the radiating structure of FIG. 2 in accordance with various aspects set forth herein.

FIG. 10 is one embodiment of a broadband monopole antenna 1000 with dual radiating structures utilizing the radiating structure 200 of FIG. 2 in accordance with various aspects set forth herein. In FIG. 10, the antenna 1000 can include a pair of radiating structures 200*a* and 200*b*, a ground plane 1036, a first feed point 1040*a*, a second feed point 1040*b*, a feeding line 1042, a first slot 1048*a* with a corresponding first open-ended strip 1046*a*, and a second slot 1049*b* with a corresponding second open-ended strip 1046*b*.

The antenna 1000 can include a symmetric pair of structures 200*a* and 200*b* about a central axis 1031, wherein each structure 200*a* and 200*b* can have a feed point 1040*a* and 1040*b*, respectively, at its base along the central axis 1031. Further, the shape of the first and second radiating structures 200*a* and 200*b* can be generally square figures. It is important to recognize that while this exemplary embodiment uses generally square figures for the shape of the first and second radiating structures 200*a* and 200*b*, other shapes can be used such as a circle, rectangle, triangle, oval, cone, petal, diamond, some other similar shape, or any combination thereof.

In this embodiment, the antenna 1000 can resonate and operate in one or more frequency bands. For example, an RF signal in one of the operating frequency bands is received by the antenna 1000 and converted from an electromagnetic signal to an electrical signal for input to a receiver, wherein the receiver is electrically connected to the antenna 1000 via the feed points 1040*a* and 1040*b*. Similarly, an electrical signal in one of the operating frequency bands is input to the antenna 1000 for conversion to an electromagnetic signal via the feed points 1040*a* and 1040*b*, which are electrically connected to a transmitter.

In the current embodiment, the ground plane 1036 can be formed from any conducting or partially conducting material such as a portion of a circuit board, copper planar, or both. The feeding line 1042 can pass through or around the ground plane 1036 to be electrically connected to the first and second feed points 1040*a* and 1040*b*, which can be located at the base of each radiating structure 200*a* and 200*b*, respectively. The feeding line 1042 can be, for instance, a micro-strip feed line, a probe feed, an aperture-coupled feed, a proximity coupled feed, other feed, or any combination thereof. The feeding line 1042 can be, for instance, placed on the surface of ground plane 1036 and electrically connected to the first and second feed points 1040*a* and 1040*b*, respectively, for transmitting RF signals, receiving RF signals, or both. The feeding line 1042 can be, for example, a sub-miniature version A ("SMA") connector, wherein an internal terminal can act as a feeding point to the first and second feed points 1040*a* and 1040*b*, respectively, and the outside terminal can be electrically connected to the ground plane 1036. SMA connectors are coaxial RF connectors developed as a minimal connector interface for a coaxial cable with a screw-type coupling mechanism. An SMA connector typically has a fifty-ohm impedance and offers excellent electrical performance over a broad frequency range.

In FIG. 10, the first slot 1048*a* can be formed in a central location of radiating structure 200*a* along the central axis 1031. Further, the first open-ended strip 1046*a* corresponding to first slot 1048*a* can be formed in a central location of radiating structure 200*a* along the central axis 1031. Similarly, the second slot 1048*b* can be formed in a central location of radiating structure 200*b* along the central axis 1032. Further, the second open-ended strip 1046*b* corresponding to second slot 1048*b* can be formed in a central location of radiating structure 200*a* along the central axis 1031. The length and width of the first and second slots 1048*a* and 1048*b*, respectively, can be adjusted to modify the operating frequency bandwidth, input impedance, resonant frequency, polarization characteristics, or any combination thereof of the antenna 1000. Similarly, the length, width, and shape of the first and second open-ended strips 1048*a* and 1048*b*, respectively, can be adjusted to modify the operating frequency bandwidth, input impedance, resonant frequency, polarization characteristics, or any combination thereof of the antenna 1000. Further, the angle of the first and second open-ended strips 1046*a* and 1046*b* relative to the radiating structure 200*a* and 200*b*, respectively, can be adjusted to modify the operating frequency bandwidth, input impedance, resonant frequency, polarization characteristics, or any combination thereof of the antenna 1000.

In another embodiment, the first open-ended strip 1046*a* corresponding to first slot 1048*a* can be formed in a central location of the radiating structure 200*a* along the central axis 1031, wherein a side of the open-ended strip 1046*a* can extend to the edge of the radiating structure 200*a* to form a notch. Similarly, the second open-ended strip 1046*b* corresponding to second slot 1048*b* can be formed in a central location of radiating structure 200*a* along the central axis 1031, wherein a side of the open-ended strip 1046*b* can extend to the edge of the radiating structure 200*b* to form a notch.

In another embodiment, the feeding line 1042 can be configured as a coaxial cable with an internal terminal electrically connected to the first and second feed points 1040*a* and 1040*b*, respectively, and the outside terminal electrically connected to the ground plane 1036.

In another embodiment, the feeding line 1042 can be differentially configured as a coaxial cable with an internal terminal electrically connected to the first feed point 1040*a* and the outside terminal electrically connected to the second feed point 1040*b*.

In another embodiment, a dielectric material can be set between any combination of the radiating structure 200*a*, the radiating structure 200*b*, and the ground plane 1036.

Figure 11:
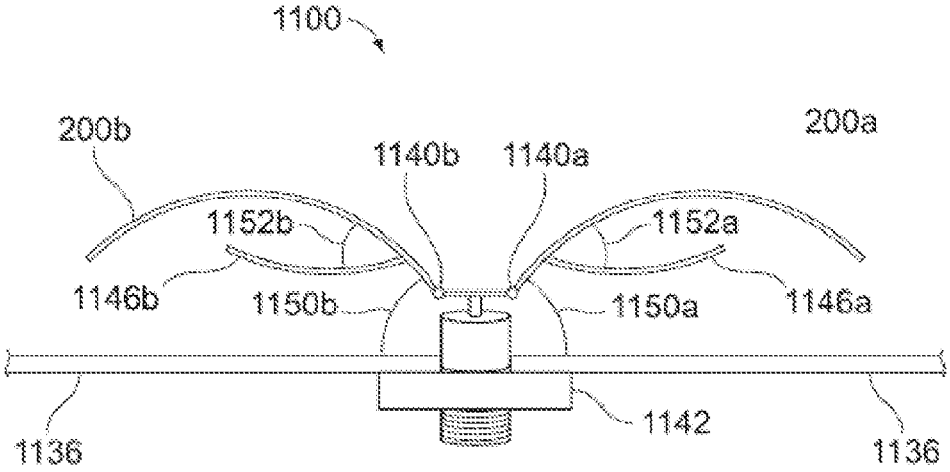
FIG. 11 illustrates a side view of another embodiment of a broadband monopole antenna with dual radiating structures utilizing the radiating structure of FIG. 2 in accordance with various aspects set forth herein.

FIG. 11 illustrates a side view of another embodiment of a broadband monopole antenna 1100 with dual radiating structures utilizing the radiating structure of FIG. 2 in accordance with various aspects set forth herein. In FIG. 11, the antenna 1100 can include a pair of radiating structures 200*a* and 200*b*, a ground plane 1136, a first feed point 1140*a*, a second feed point 1140*b*, a feeding line 1142, a first slot with a corresponding first open-ended strip 1146*a*, and a second slot with a corresponding second open-ended strip 1146*b*. The antenna 1100 can include a symmetric pair of structures 200*a* and 200*b* about a central axis, wherein each structure 200*a* and 200*b* can have a feed point 1140*a* and 1140*b*, respectively, at its base along the central axis. Further, the shape of the first and second radiating structures 200*a* and 200*b* can be generally a circle, petal, rectangle, triangle, oval, cone, square, diamond, some other similar shape, or any combination thereof.

In this embodiment, the ground plane 1136 can be formed from any conducting or partially conducting material such as a portion of a circuit board, copper planar, or both. The feeding line 1142 can pass through or around the ground planar 1136 to be electrically connected to the first and second feed points 1140*a* and 1140*b*, which can be located at the base of each radiating structure 200*a* and 200*b*, respectively. The feeding line 1142 can be, for instance, a micro-strip feed line, a probe feed, an aperture-coupled feed, a proximity coupled feed, other feed, or any combination thereof. The feeding line 1142 can be, for instance, placed on the surface of ground plane 1136 and electrically connected to the first and second feed points 1140*a* and 1140*b*, respectively, for transmitting RF signals, receiving RF signals, or both.

In addition, a first angle 1150*a* measured between the structure 200*a* and ground plane 1136 can be adjusted to modify the operating frequency bandwidth, input impedance, resonant frequency, polarization characteristics, or any combination thereof of the antenna 1100. Similarly, a second angle 1150*b* measured between the structure 200*b* and the ground plane 1136 can be adjusted to modify the operating frequency bandwidth, input impedance, resonant frequency, polarization characteristics, or any combination thereof of the antenna 1100. Further, a third angle 1152*a* measured between the strip 1146*a* and the structure 200*a* can be adjusted to modify the operating frequency bandwidth, input impedance, resonant frequency, polarization characteristics, or any combination thereof of the antenna 1100. Similarly, a fourth angle 1152*b* measured between the strip 1146*b* and the structure 200*b* can be adjusted to modify the operating frequency bandwidth, input impedance, resonant frequency, polarization characteristics, or any combination thereof of the antenna 1100. The angles 1150*a*, 1150*b*, 1152*a* and 1152*b* can be in the range from zero degrees to three hundred and sixty degrees. It is important to recognize that modifying the operating frequency bandwidth, input impedance, resonant frequency, polarization characteristics, or any combination thereof may require individually or collectively adjusting any of the angles 1150*a*, 1150*b*, 1152*a*, and 1152*b* to achieve the desired results.

In this embodiment, the radiating structure 200*a*, the radiating structure 200*b*, the ground plane 1136, the first open-ended strip 1146*a*, the second open-ended strip 1146*b*, or any combination thereof may be curved, bent, arched, contorted, twisted or any combination thereof to modify the operating frequency bandwidth, input impedance, resonant frequency, polarization characteristics, or any combination thereof of the antenna 1100. Further, the radiating structure 200*a*, the radiating structure 200*b*, the ground plane 1136, the feeding line 1142, the first open-ended strip 1146*a*, the second open-ended strip 1146*b*, or any combination thereof may be curved, bent, arched, contorted, twisted, spiraled, or any combination thereof to, for instance, reduce the length, width, depth or any combination thereof of the antenna 1100, conform to surface profiles, conform to the housing of a wireless device or base station, conform to the internal structure of a wireless device or base station, or any combination thereof.

In FIG. 11, the radiating structures 200*a* and 200*b* can be curved towards the ground plane 1136 to, for instance, reduce the height of the antenna 1100. Further, the first and second open-ended strips 1146*a* and 1146*b* can be curved towards its respective radiating structure 200*a* and 200*b*, respectively, to, for instance, reduce the height of the antenna 1100.

In another embodiment, the feeding line 1142 can be configured as a coaxial cable with an internal terminal electrically connected to the first and second feed points 1140*a* and 1140*b*, respectively, and the outside terminal electrically connected to the ground plane 1136.

In another embodiment, the feeding line 1142 can be differentially configured as a coaxial cable with an internal terminal electrically connected to the first feed point 1140*a* and the outside terminal electrically connected to the second feed point 1140*b*.

In another embodiment, a dielectric material can be set between any combination of the radiating structure 200*a*, the radiating structure 200*b*, and the ground plane 1136.

Figure 12:
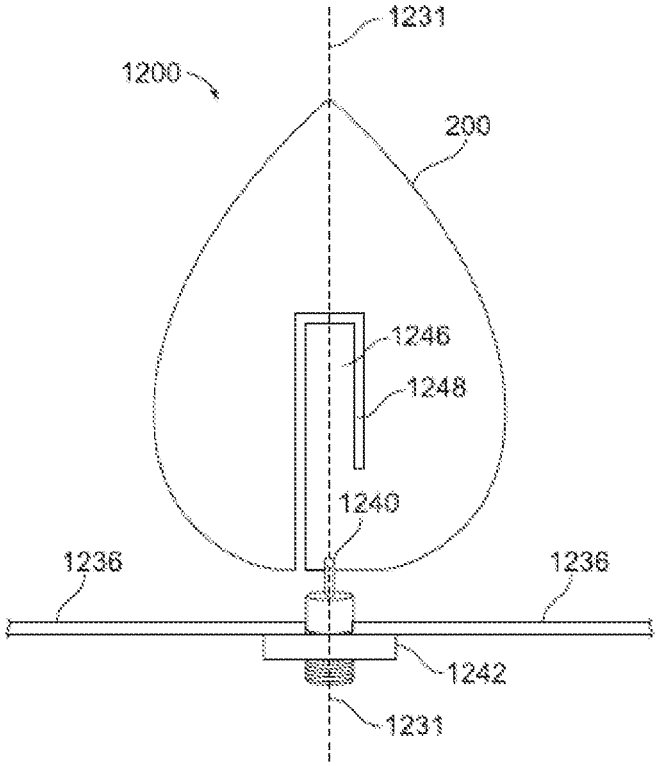
FIG. 12 illustrates a side view of one embodiment of a broadband monopole antenna with a single radiating structure utilizing the radiating structure of FIG. 2 in accordance with various aspects set forth herein.

FIG. 12 is one embodiment of a broadband monopole antenna 1200 utilizing a single radiating structure 200 of FIG. 2. The antenna 1200 can include the radiating structure 200, a ground plane 1236, a feed point 1240, a feeding line 1242, and a slot 1248 with a corresponding open-ended strip 1246. The radiating structure 200 can be symmetric about a central axis 1231. Further, the shape of the radiating structure 200 can be a generally petal figure. It is important to recognize that while this exemplary embodiment uses a generally petal figure for the shape of the radiating structure 200, other shapes can be used such as a circle, rectangle, triangle, oval, cone, square, diamond, some other similar shape, or any combination thereof.

In FIG. 12, the antenna 1200 can resonate and operate in one or more frequency bands. For example, an RF signal in one of the operating frequency bands is received by the antenna 1200 and converted from an electromagnetic signal to an electrical signal for input to a receiver, wherein the receiver is electrically connected to the antenna 1200 via the feed point 1240. Similarly, an electrical signal in one of the operating frequency bands is input to the antenna 1200 for conversion to an electromagnetic signal via the feed points 1240, which is electrically connected to a transmitter.

In this embodiment, the ground plane 1236 can be formed from any conducting or partially conducting material such as a portion of a circuit board, copper sheet, or both. The radiating structure 200 can have a feed point 1240 at its base and along the central axis 1231. Further, the feeding line 1242 can pass through or around the ground plane 1236 to the base of the radiating structure 200 to the feed point 1240.

In addition, the slot 1248 can be formed in a central location of radiating structure 200*a* along the central axis 1231. Further, the open-ended strip 1246 corresponding to slot 1248 can be formed in a central location of radiating structure 200*a* along the central axis 1231, a side of the open-ended strip 1246 can extend to the edge of the radiating structure 200 to form a notch. The length and width of the slot 1248 can be adjusted to modify the operating frequency bandwidth, input impedance, resonant frequency, or any combination thereof of the antenna 1200. Similarly, the length, width, and shape of the open-ended strip 1248 can be adjusted to modify the operating frequency bandwidth, input impedance, resonant frequency, or any combination thereof of the antenna 1200. Further, the angle of the open-ended strip 1246 relative to the central location of the radiating structure 200 can be adjusted to modify the operating frequency bandwidth, input impedance, resonant frequency, or any combination thereof of the antenna 1200.

In another embodiment, the first open-ended strip 1246 corresponding to the slot 1248 can be formed in a central location of the radiating structure 200 along the central axis 1231, wherein no sides of the open-ended strip 1246 can extend to the edge of the radiating structure 200 to form a notch.

In another embodiment, a dielectric material can be set between the radiating structure 200 and the ground plane 1236.

Figure 13:
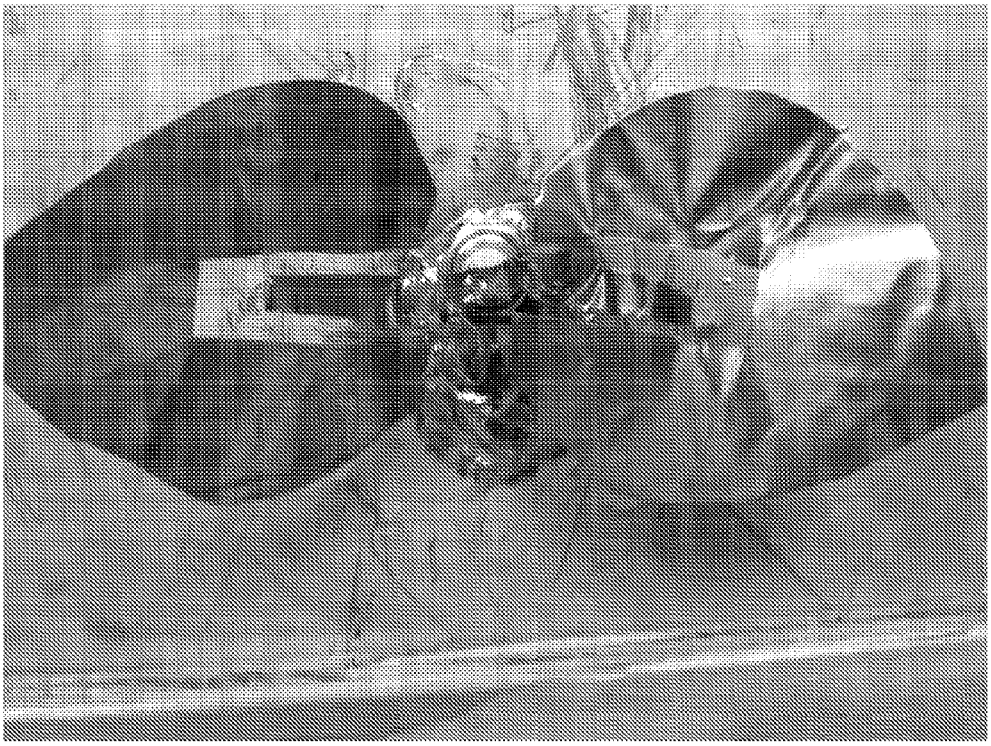
FIG. 13 shows a photograph of a top view of an example of the broadband monopole antenna with dual radiating structures of FIG. 5.

FIG. 13 shows a photograph of a top view of an example of the broadband monopole antenna 500 with dual radiating structures of FIG. 5. The photograph in its entirety is referred to by 1300. The length of each radiating structure is thirty-five millimeters from the feed point at the base of the radiating structure to the tip of the radiating structure. Further, the width of each radiating structure is thirty-five millimeters at its widest point. Each slot and strip is ten millimeters long and three millimeters wide.

Figure 14:
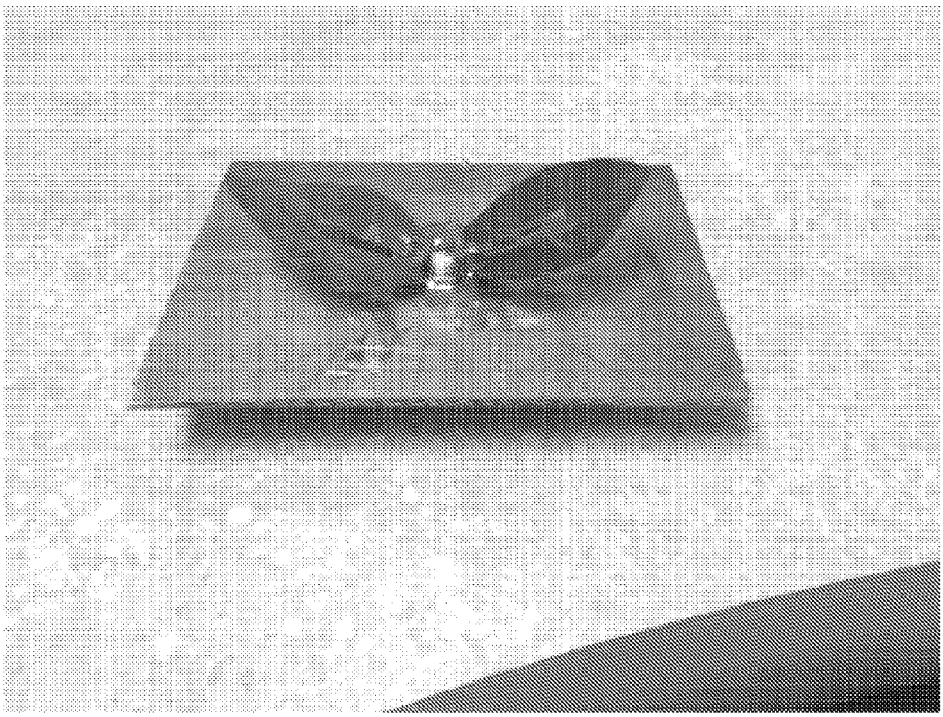
FIG. 14 shows a photograph of a panoramic view of an example of the broadband monopole antenna with dual radiating structures of FIG. 5.

FIG. 14 shows a photograph of a panoramic view of an example of the broadband monopole antenna 500 with dual radiating structures of FIG. 5. The photograph in its entirety is referred to by 1400. The length of each radiating structure is thirty-five millimeters from the feed point at the base of the radiating structure to the tip of the radiating structure. Further, the width of each radiating structure is thirty-five millimeters at its widest point. Each slot and strip is ten millimeters long and three millimeters wide.

Figure 15:
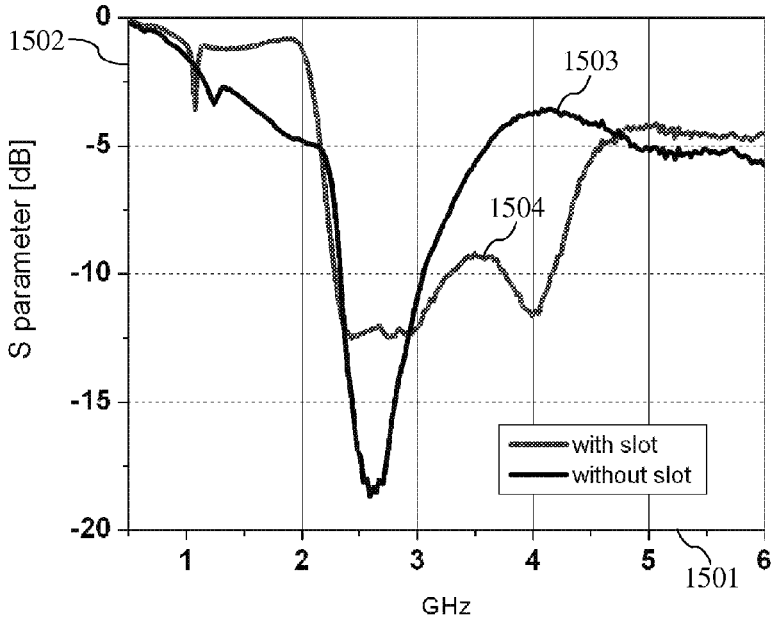
FIG. 15 illustrates measured results for the broadband monopole antenna with dual radiating structures of FIGS. 13 and 14.

FIG. 15 illustrates measured results for the example of the broadband monopole antenna 500 with dual radiating structures as shown in FIGS. 13 and 14. The graphical illustration in its entirety is referred to by 1500. The frequency from 500 MHz to 6 GHz is plotted on the abscissa 1501. The logarithmic magnitude of the input reflection factor S is shown on the ordinate 1502 and is plotted in the range from 0 dB to −20 dB. Graph 1503 shows the measured results for the broadband monopole antenna 500 without slots 548*a* and 548*b* and their corresponding strips 546*a* and 546*b*, respectively. Graph 1504 shows the measured results for the broadband monopole antenna 500 with slots 548*a* and 548*b* and their corresponding strips 546*a* and 546*b*, respectively. The results show that a broadband monopole antenna with slots and corresponding strips can substantially increase the frequency bandwidth over a broadband monopole antenna without slots and corresponding strips.

Figure 16:
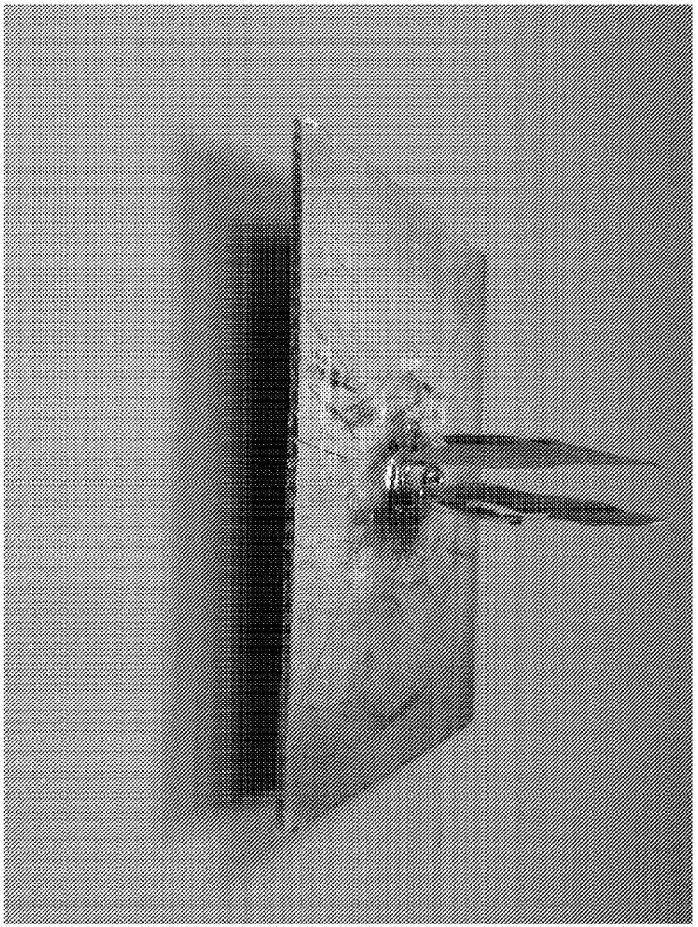
FIG. 16 shows a photograph of a side view of an example of the broadband monopole antenna with dual radiating structures of FIG. 7.

FIG. 16 shows a photograph of a side view of an example of the broadband monopole antenna 700 with dual radiating structures of FIG. 7. The photograph in its entirety is referred to by 1600. The length of each radiating structure is thirty-five millimeters from the feed point at the base of the radiating structure to the tip of the radiating structure. Further, the width of each radiating structure is thirty-five millimeters at its widest point. Each slot and strip is ten millimeters long and three millimeters wide.

Figure 17:
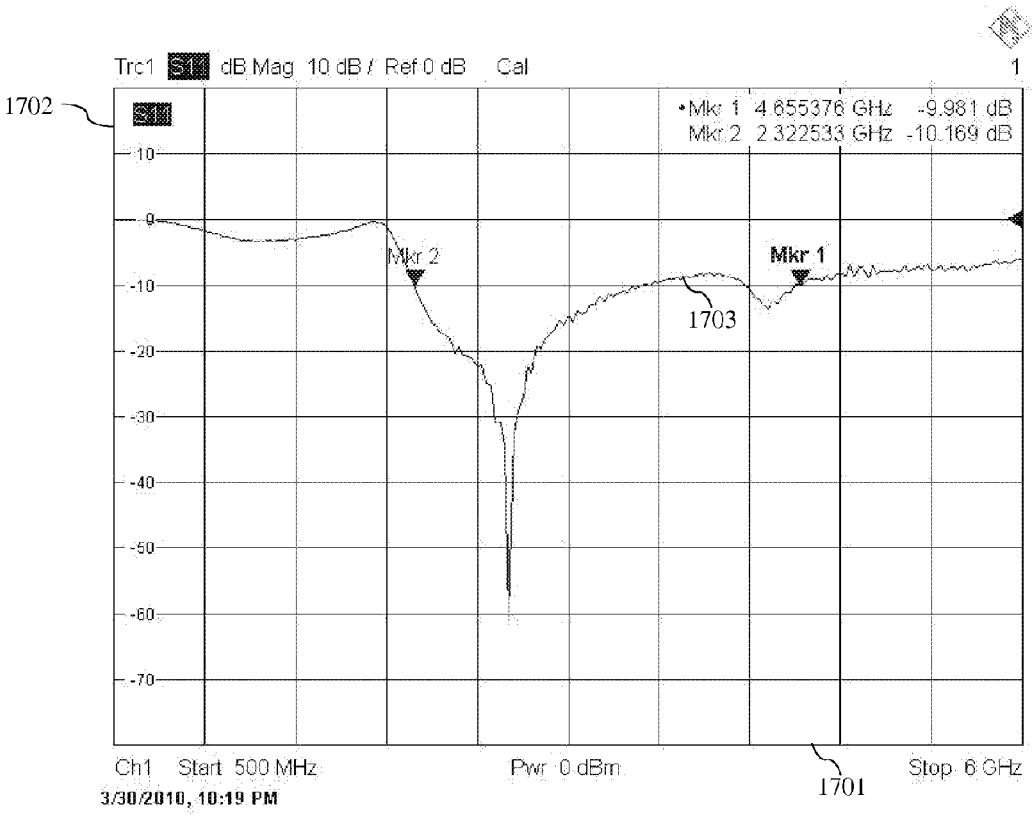
FIG. 17 illustrates measured results for the broadband monopole antenna with dual radiating structures of FIG. 16.

FIG. 17 illustrates measured results for the broadband monopole antenna 700 with dual radiating structures as shown in FIG. 16. The graphical illustration in its entirety is referred to by 1700. The frequency from 500 MHz to 6 GHz is plotted on the abscissa 1701. The logarithmic magnitude of the input reflection factor S is shown on the ordinate 1702 and is plotted in the range from 20 dB to −80 dB. Graph 1703 shows the measured results for the broadband monopole antenna 700. The results show that the broadband monopole antenna 700 has a frequency bandwidth of about 2.4 GHz.

Figure 18:
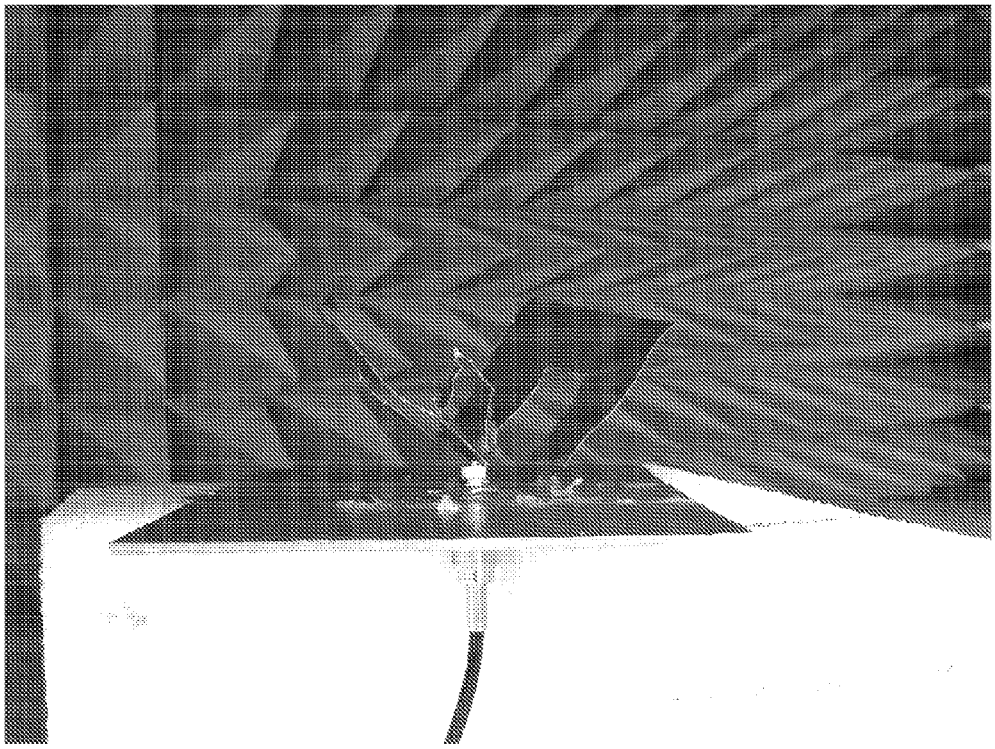
FIG. 18 shows a photograph of a side view of an example of the broadband monopole antenna with dual radiating structures of FIG. 9.

FIG. 18 shows a photograph of a side view of an example of the broadband monopole antenna 900 with dual radiating structures of FIG. 9. The photograph in its entirety is referred to by 1800. The length and width of each radiating structure is thirty-five millimeters. Each slot and strip is ten millimeters long and three millimeters wide.

Figure 19:
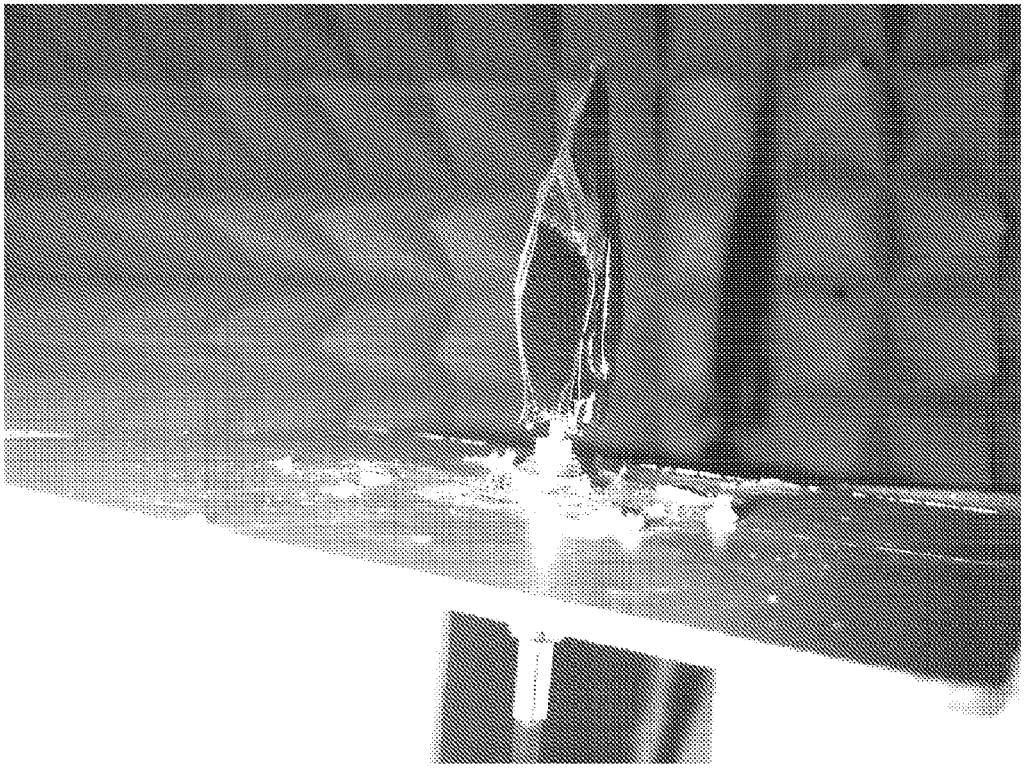
FIG. 19 shows a photograph of a side view of an example of the broadband monopole antenna with a single radiating structures of FIG. 12.

FIG. 19 shows a photograph of a side view of an example of the broadband monopole antenna with a single radiating structure of FIG. 12. The photograph in its entirety is referred to by 1900. The length of the radiating structure is thirty-five millimeters from the feed point at the base of the radiating structure to the tip of the radiating structure. Further, the width of the radiating structure is thirty-five millimeters at its widest point. Each slot and strip is ten millimeters long and three millimeters wide.

Figure 20:
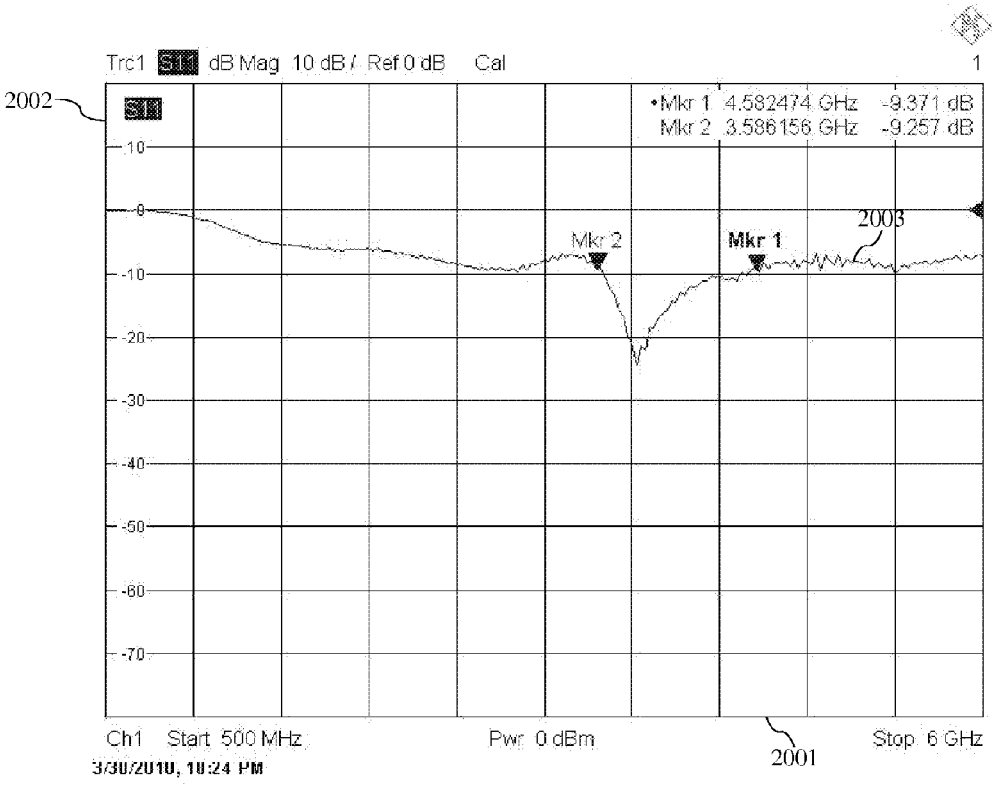
FIG. 20 illustrates measured results for the broadband monopole antenna with a single radiating structure of FIG. 19.

FIG. 20 illustrates measured results for the broadband monopole antenna 1200 with a single radiating structure as shown in FIG. 19. The graphical illustration in its entirety is referred to by 2000. The frequency from 500 MHz to 6 GHz is plotted on the abscissa 1701. The logarithmic magnitude of the input reflection factor S is shown on the ordinate 1702 and is plotted in the range from 20 dB to −80 dB. Graph 2003 shows the measured results for the broadband monopole antenna 1200 with a single radiating structure. The results show that the broadband monopole antenna 1200 has a frequency bandwidth of about 1.0 GHz. Therefore, comparing the results of FIG. 17 and FIG. 20 shows that a broadband antenna with dual radiating structures can provide significantly improved frequency bandwidth over a broadband antenna with a single radiating structure.

Having shown and described exemplary embodiments, further adaptations of the methods, devices and systems described herein may be accomplished by appropriate modifications by one of ordinary skill in the art without departing from the scope of the present disclosure. Several of such potential modifications have been mentioned, and others will be apparent to those skilled in the art. For instance, the exemplars, embodiments, and the like discussed above are illustrative and are not necessarily required. Accordingly, the scope of the present disclosure should be considered in terms of the following claims and is understood not to be limited to the details of structure, operation and function shown and described in the specification and drawings.

As set forth above, the described disclosure includes the aspects set forth below.

The invention claimed is:

1. An antenna, comprising:

a ground plane;

a first radiating structure having a symmetric configuration along a central axis, a first feed point electrically connected to a base of said first radiating structure along said central axis; and a single first slot physically partitioning the first radiating structure into a first subset of radiating members;

a first reactive loading element formed in central location of said first radiating structure to modify the operating frequency bandwidth, input impedance, resonant frequency, polarization characteristics, or any combination thereof of the antenna wherein the first reactive loading element is comprised of a first open-ended strip along said central axis, sides of said first open ended strip being defined by said first slot.

2. The antenna of claim 1, wherein a side of the first open-ended strip extends to an edge of the first radiating structure.

3. The antenna of claim 1, wherein no sides of the first open-ended strip extend to an edge of the radiating structure.

4. The antenna of claim 1, further including:

a second radiating structure conjoined with said first radiating structure having a symmetric configuration along said central axis, comprising:

a second feed point electrically connected to the base of said second radiating structure along said central axis; and a single second slot physically partitioning the second radiating structure into a second subset of radiating members; and a second reactive loading element firmed in a central location of said second radiating structure to modify the operating frequency bandwidth, input impedance, resonant frequency, polarization characteristics, or any combination thereof of the antenna.

5. The antenna of claim 4, wherein the second reactive loading element is comprised of a second open-ended strip along said central axis, sides of said second open ended strip being defined by said second slot.

6. The antenna of claim 5, wherein no sides of the first open-ended strip and the second open ended strip extend to an edge of the radiating structure.

7. The antenna of claim 5, wherein a side of the first open-ended strip and a side of the second open ended strip extends to edges of their respective radiating structures.

8. The antenna of claim 4, wherein said first and said second feed points are electrically connected to a transmitter, receiver, or both.

9. The antenna of claim 4, wherein said first and said second feed points are electrically connected to a first conductor of a coaxial connector, and said ground plane is electrically connected to a second conductor of said coaxial connector.

10. The antenna of claim 4, wherein said first feed point is electrically connected to a first conductor of a coaxial connector, and said second feed point is electrically connected to a second conductor of said coaxial connector.

11. The antenna of claim 4, wherein adjusting a first angle between said first radiating structure and said ground plane, adjusting a second angle between said second radiating structure and said ground plane, or both modifies the operating frequency bandwidth, input impedance, resonant frequency, polarization characteristics, or any combination thereof of the antenna.

12. The antenna of claim 11, wherein said first and said second angles are about the same.

13. The antenna of claim 4, wherein adjusting the location, length, width, shape, or any combination thereof of said first slot, second slot, or both modifies the operating frequency bandwidth, input impedance, resonant frequency, polarization characteristics, or any combination thereof of the antenna.

14. The antenna of claim 4, wherein said first and said second slots have about the same location, length, width, shape, or any combination thereof.

15. The antenna of claim 5, wherein said first and said second open-ended strips have about the same location, length, width, shape, or any combination thereof.

16. The antenna of claim 4, wherein adjusting a third angle between said first open-ended strip and said first radiating structure, adjusting a fourth angle between said second open-ended strip and said second radiating structure, or both modifies the operating frequency bandwidth, input impedance, resonant frequency, polarization characteristics, or any combination thereof of the antenna.

17. A device in a wireless communication system, comprising:

a transmitter for transmitting information over a frequency band;

a receiver for receiving information over a frequency band; and an antenna electrically connected to said transmitter and said receiver, comprising:

a ground plane;

a first radiating structure, comprising:

a first feed point electrically connected to a base of said first radiating structure along a central axis; and a single first slot physically partitioning the first radiating structure into a first subset of radiating members; and a first reactive loading element formed in central location of said first radiating structure;

a second radiating structure conjoined with said first radiating structure, comprising:

a second feed point electrically connected to the base of said second radiating structure along a central axis, wherein said first and second feed points are configured to electrically connect said antenna to said transmitter, said receiver, or both; and a single second slot physically partitioning the second radiating structure into a second subset of radiating members; and a second reactive loading element formed in a central location of said second radiating structure, the first reactive loading element and the second reactive loading element to modify the operating frequency bandwidth, input impedance, resonant frequency, polarization characteristics, or any combination thereof of the antenna, wherein the first reactive loading element is comprised of a first open-ended strip along said central axis, sides of said first open ended strip being defined by said first slot.

18. The antenna of claim 17, wherein the second reactive loading element is comprised of a second open-ended strip along said central axis, sides of said second open ended strip being defined by said second slot.

* * * * *